US009065575B2

(12) United States Patent
Lee et al.

(10) Patent No.: US 9,065,575 B2
(45) Date of Patent: Jun. 23, 2015

(54) MOBILE TERMINAL AND BROADCAST CONTROLLING METHOD THEREOF

(75) Inventors: Won Jong Lee, Gyeonggi-do (KR); Sug Ky Hong, Seoul (KR); Eui Soon Kim, Seoul (KR); Sung Won Yoon, Gyeonggi-do (KR); Seok Hyeon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 579 days.

(21) Appl. No.: 12/944,684

(22) Filed: Nov. 11, 2010

(65) Prior Publication Data

US 2011/0124282 A1 May 26, 2011

(30) Foreign Application Priority Data

Nov. 23, 2009 (KR) ..... 10-2009-0113250
Nov. 23, 2009 (KR) ..... 10-2009-0113251

(51) Int. Cl.
*H04H 20/71* (2008.01)
*H04H 20/57* (2008.01)
*H04H 60/40* (2008.01)
*H04H 60/74* (2008.01)

(52) U.S. Cl.
CPC ..... *H04H 20/57* (2013.01); *H04H 60/40* (2013.01); *H04H 60/74* (2013.01)

(58) Field of Classification Search
USPC ..... 455/3.01, 3.03; 725/33–46, 29, 50; 348/512, 231.5, 295
See application file for complete search history.

(56) References Cited

U.S. PATENT DOCUMENTS

2001/0001160 A1* 5/2001 Shoff et al. ..... 725/51
2006/0015897 A1* 1/2006 Kim ..... 725/33
2009/0013363 A1* 1/2009 Lee et al. ..... 725/110

* cited by examiner

*Primary Examiner* — Nay A Maung
*Assistant Examiner* — Angelica M Perez
(74) *Attorney, Agent, or Firm* — Lee, Hong, Degerman, Kang & Waimey

(57) ABSTRACT

A method of controlling a broadcast in a mobile terminal includes receiving data including a first broadcast program of a first broadcast channel and first description information related to the first broadcast program, outputting the received first broadcast program, determining whether or not the received data includes reference time information, extracting first broadcast time information related to the first broadcast program from the first description information when the received data does not include the reference time information, setting a broadcast relevant reference time using the extracted first broadcast time information, and searching previously stored broadcast relevant information for specific broadcast relevant information corresponding to the set broadcast relevant reference time.

13 Claims, 42 Drawing Sheets

FIG. 7A

| Syntax | No. of Bits | Format |
|---|---|---|
| guide_access_table_MH_section() { | | |
| table_id | 8 | 0xDC |
| section_syntax_Indicator | 1 | '0' |
| private_indicator | 1 | '1' |
| reserved | 2 | '11' |
| section_length | 12 | uimsbf |
| table_id_extension { | 16 | uimsbf |
| GAT_MH_protocol_version | 8 | uimsbf |
| ensemble_id | 8 | uimsbf |
| } | | |
| reserved | 2 | '11' |
| version_number | 5 | uimsbf |
| current_next_Indicator | 1 | bslbf |
| section_number | 8 | uimsbf |
| last_section_number | 8 | uimsbf |
| numb_SG_providers | 8 | uimsbf |
| 710 for ( i = 0; i<num_SG_providers; i++) { | | |
| SG_provider_name_length | 8 | uimsbf |
| 703 SG_provider_name_text() | var | |
| 701 MH_service_id | 16 | uimsbf |
| 702 announcement_channel_tsi | 16 | uimsbf |
| } | | |
| } | | |
| } | | |

FIG. 7B

| Syntax | No. of Bits | Format |
|---|---|---|
| service_map_table_MH_section(0 { | | |
| table_id | 8 | 0xDB |
| section_syntax_indicator | 1 | '0' |
| private_indicator | 1 | '1' |
| reserved | 2 | '11' |
| section_length | 12 | uimsbf |
| table_id_extension { | | |
| SMT_MH_protocol_version | 8 | uimsbf |
| ensemble_id | 8 | uimsbf |
| } | | |
| reserved | 2 | '11' |
| version_number | 5 | uimsbf |
| current_next_indicator | 1 | bslbf |
| section_number | 8 | uimsbf |
| last_section_number | 8 | uimsbf |
| num_MH_services | 8 | uimsbf |
| for (I = 0; I<num_MH_services; ++I) | | |
| { | | |
| 711 MH_service_id | 16 | uimsbf |
| multi_ensemble_service | 2 | uimsbf |
| MH_service_status | 2 | uimsbf |
| SP_Indicator | 1 | bslbf |
| short_MH_service_naem_length /*m*/ | 3 | uimsbf |
| short_MH_service_name | 16*m | |
| reserved | 2 | '11' |
| MH_service_category | 6 | uimsbf |
| num_components | 5 | uimsbf |
| IP_version_flag | 1 | bslbf |
| source_IP_address_flag | 1 | bslbf |
| HM_service_destination_IP_address_flag | 1 | bslbf |
| If(source_IP_address_flag) | | |
| source_IP_address | 32 or 128 | uimsbf |
| 720 If(MH_service_destnation_IP_address_flag) | | |
| MH_service_destination_IP_address | 32 or 128 | uimsbf |
| for (j =0; j<num_components; j++) | | |
| { | | |
| reserved | | |
| essential_component_indicator | | |
| component_destination_IP_address_flag | 1 | bslbf |
| port_num_count | 5 | uimsbf |
| component_destination_UDP_port_num | 16 | uimsbf |
| 730 If(component_destination_IP_address_flag) | | |
| component_destination_IP_address | 32 or 128 | uimsbf |
| ⋮ | | |

FIG. 8

| | Name | Type | Category | Cardinality | Description | Data Type |
|---|---|---|---|---|---|---|
| 810 | ServiceGuide Delivery Descriptor | E | | | The Service Guide Delivery Descriptor<br>Contains the following attributes:<br>id<br>version<br><br>Contains the following elements:<br>NotificationReception<br>BSMList<br>DescriptorEntry | |
| 820 | Descriptor Entry | E1 | NM/ TM | 1..N | An entry in the Service Guide Delivery Descriptor.<br>Contains the following attribute:<br>type<br>Contains the following elements:<br>GroupingCriteria,<br>Transport,<br>AlternativeAccessURL,<br>ServiceGuideDeliveryUnit (822) | |
| 830 | Transport | E2 | NM/ TM | 0..N | The pointer to the transport session delivering the Service Guide fragments within Service Guide Delivery Units announced in this DescriptorEntry.<br>Contains the following attributes:<br>ipAddress,<br>port,<br>srcIpAddress,<br>transmissionSessionID,<br>hasFDT | |
| 840 | fragmentType | A | NM/ TM | 0..1 | This field signals the type of an XML encoded BCAST Service Guide fragment, with the following values:<br>0 - unspecified<br>1 - 'Service' Fragment<br>2 - 'Content' fragment<br>3 - 'Schedule' Fragment<br>4 - 'Access' Fragment<br>5 - 'PurchaseItem' Fragment<br>6 - 'PurchaseData' Fragment<br>7- 'PurchaseChannel' Fragment<br>8 - 'PreviewData' Fragment<br>9 - 'InteractivityData' Fragment | unsigned Byte |

FIG. 9

| Data Field Name | Data Type |
|---|---|
| Service_Guide_Delivery_Unit { | |
| Unit_Header { | |
| extension_offset | uimsbf32 |
| reserved | 16bits |
| n_o_service_guide_fragments | uimsbf24 |
| for(i=0; i< n_o_service_guide_fragments; i++) { | |
| fragmentTransportID[i] | uimsbf32 |
| fragmentVersion[i] | uimsbf32 |
| offset[i] | uimsbf32 |
| } | |
| } | |
| Unit_Payload { | |
| for(i=0; i< n_o_service_guide_fragments; i++) { | |
| fragmentEncoding[i] | uimsbf8 |
| if(fragmentEncoding[i]=0) { | |
| fragmentType | uimsbf8 |
| XMLFragment | bytestring |
| } | |
| ... | |

901

902

FIG. 10

| | Syntax | No. of Bits | Format |
|---|---|---|---|
| | MH current program descriptor() { | | |
| | descriptor tag | 8 | 0XBE |
| | descriptor length | 8 | uimsbf |
| 1001 | current program start time | 4*8 | uimsbf |
| 1002 | current program duration | 3*8 | uimsbf |
| | title length | 8 | uimsbf |
| 1003 | title text() | var | |
| | } | | |

FIG. 17A

Interactivity Fragment

ServiceReference = "KBS"
ScheduleReference = "MBC_INT_1"
InteractivityWindow =
- StartTime = "2009-10-11, 12:30"
- EndTime = "2009-10-11, 16:20"
- Title = Program A

1710

Interactivity Fragment

ServiceReference = "MBC"
ScheduleReference = "MBC_INT_2"
InteractivityWindow =
- StartTime = "2009-10-11, 16:20"
- EndTime = "2009-10-11, 20:20"
- Title = Program B

1720

Interactivity Fragment

ServiceReference = "MBC"
ScheduleReference = "MBC_INT_3"
InteractivityWindow =
- StartTime = "2009-10-11, 20:20"
- EndTime = "2009-10-11, 22:00"
- Title = Program C

1730

FIG. 17B

Schedule Fragment

ServiceReference = "MBC_INT_SCH"
ScheduleReference = "MBC"
InteractivityDataReference
- idRef = "MBC_INT_2"

1740

FIG. 17C

Access Fragment

ServiceReference = "MBC"
ScheduleReference = "MBC_INT_SCH"

1750

FIG. 26A

| Current Program Descriptor | |
|---|---|
| Start time | 10:30 |
| End time | 11:30 |
| Broadcast duration | 1 hour |
| Title | 2nd program |

2601

2602

FIG. 26B

| Content Fragment | |
|---|---|
| Start time | 10:00 |
| End time | 11:00 |
| Broadcast duration | 1 hour |
| Title | 2nd program |

2603

2604

FIG. 26C

| Schedule list - CH 1 |
|---|
| 9:00 ~ 10:00 1st program |
| 10:00 ~ 11:00 2nd program |
| 11:00 ~ 12:00 3rd program |
| 12:00 ~ 13:00 4th program |
| ⋮ |

2605

FIG. 26D

| Schedule list - CH 1 |
|---|
| 9:00 ~ 10:00 1st program |
| 10:30 ~ 11:30 2nd program |
| 11:30 ~ 12:30 3rd program |
| 12:30 ~ 13:30 4th program |
| ⋮ |

2606

| Content Fragment | |
|---|---|
| Start time | 10:00 |
| End time | 11:00 |
| Broadcast duration | 1 hour |
| Title | 2nd program |

2701

| Current Program Descriptor | |
|---|---|
| Start time | 10:00 |
| End time | 11:00 |
| Broadcast duration | 1 hour |
| Title | News flash |

2702

Schedule list - CH 1

9:00 ~ 10:00 1st program
2703 10:00 ~ 11:00 News flash
11:00 ~ 12:00 3rd program
12:00 ~ 13:00 4th program
⋮

FIG. 28A

| Current Program Descriptor | | |
|---|---|---|
| Start time | 10:30 | 2801 |
| End time | 11:00 | 2802 |
| Broadcast duration | 30 munites | 2803 |
| Title | News flash | 2804 |

FIG. 28B

| Content Fragment | | |
|---|---|---|
| Start time | 10:00 | 2603 |
| End time | 11:00 | 2604 |
| Broadcast duration | 1 hour | 2807 |
| Title | 2nd program | 2808 |

FIG. 28C

| | Schedule list - CH 1 |
|---|---|
| | 9:00 ~ 10:00 1st program |
| | 10:00 ~ 10:30 2nd program |
| 2805 | 10:30 ~ 11:00 News flash |
| 2806 | 11:00 ~ 11:30 2nd program |
| | 11:30 ~ 12:30 3rd program |
| | 12:30 ~ 13:30 4th program |
| | ⋮ |

FIG. 28D

| | Schedule list - CH 1 |
|---|---|
| | 9:00 ~ 10:00 1st program |
| | 10:00 ~ 10:30 2nd program |
| 2805 | 10:30 ~ 11:00 News flash |
| | 11:00 ~ 12:00 3rd program |
| | 12:00 ~ 13:00 4th program |
| | ⋮ |

MOBILE TERMINAL AND BROADCAST CONTROLLING METHOD THEREOF

CROSS-REFERENCE TO RELATED APPLICATIONS

Pursuant to 35 U.S.C. §119(a), this application claims the benefit of an earlier filing date and right of priority to Korean Application No. 10-2009-0113250, filed on Nov. 23, 2009, and Korean Application No. 10-2009-0113251, filed on Nov. 23, 2009, the contents of which are hereby incorporated by reference herein in their entirety.

FIELD OF THE INVENTION

The present disclosure relates to a mobile terminal, and more particularly, to a mobile terminal and broadcast controlling method thereof. Although the present invention is suitable for a wide scope of applications, it is particularly suitable for providing broadcast relevant information relevant to a specific timing point in a terminal for broadcasting.

DESCRIPTION OF THE RELATED ART

Conventionally, terminals can be classified as mobile or portable terminals and stationary terminals. The mobile terminals can be classified as handheld terminals and vehicle mount terminals according to a user's direct portability.

As functions of the terminal are diversified, the terminal is implemented as a multimedia player provided with composite functions such as capturing photographs or moving pictures, playing back music or moving picture files, playing games and receiving broadcasts. To support the increasing number of terminal functions, it may be desirable to improve either the structural or software parts of the terminal.

In some conventional systems, a broadcast receiving terminal receives a data stream in predetermined periods and sets a broadcast relevant reference time using broadcast time relevant information delivered via the data stream. According to the Advanced Television Systems Committee-Mobile/Handheld (ATSC-M/H) Standard (hereinafter "the ATSC-MH standard"), a mobile terminal receives a data packet containing a reference time from a server every 10 minutes and the mobile terminal then sets the broadcast relevant reference time using the reference time contained in the received data packet.

However, the related art is unable to set a current broadcast relevant time when broadcast time relevant information is not provided via a broadcast data stream. Additionally, the related art is unable to search the broadcast relevant information when the period for receiving a data packet exceeds a specific timing point for searching broadcast relevant information.

In other conventional systems, the broadcasting terminal updates previously stored broadcast relevant information with reference to received broadcast relevant information if the received broadcast relevant information from a broadcast relevant server is different from the previously stored broadcast relevant information. However, the related art is unable to provide the changed broadcast relevant information to a user when a currently received or output broadcast program such as a broadcast start and end time, broadcast time, or a broadcast program title is substantially changed unless broadcast relevant information containing the substantially changed information is received.

SUMMARY

Accordingly, the present invention is directed to a mobile terminal and broadcast controlling method thereof that substantially obviate one or more problems due to limitations and disadvantages of the related art.

An object of the present invention is to provide a mobile terminal and broadcast controlling method thereof, by which a broadcast relevant reference time can be set using broadcast time information contained in description information on a currently received broadcast program.

Another object of the present invention is to provide a mobile terminal and broadcast controlling method thereof, by which specific broadcast relevant information can be searched using a broadcast relevant reference time set using broadcast time information corresponding to a currently received broadcast program.

A further object of the present invention is to provide a mobile terminal and broadcast controlling method thereof, by which previously stored broadcast relevant information can be updated using description information on a currently received broadcast program.

Additional advantages, objects, and features of the invention will be set forth in part in the description which follows and in part will become apparent to a person having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a mobile terminal according to an embodiment of the present invention includes a wireless communication unit configured to receive data including a first broadcast program of a first broadcast channel and first description information related to the first broadcast program, an output unit configured to output the received first broadcast program, a memory unit configured to store first broadcast relevant information included in the received data, and a controller unit configured to extract first broadcast time information related to the first broadcast program from the first description information when the received data does not include reference time information, in which the controller unit sets a broadcast relevant reference time using the extracted first broadcast time information, and the controller unit searches the stored first broadcast relevant information for specific broadcast relevant information corresponding to the set broadcast relevant reference time.

In another aspect of the present invention, a method of controlling a broadcast in a mobile terminal includes receiving data including a first broadcast program of a first broadcast channel and first description information related to the first broadcast program, outputting the received first broadcast program, determining whether or not the received data includes reference time information, extracting first broadcast time information related to the first broadcast program from the first description information when the received data does not include the reference time information, setting a broadcast relevant reference time using the extracted first broadcast time information, and searching previously stored broadcast relevant information for specific broadcast relevant information corresponding to the set broadcast relevant reference time.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the disclosure and together with the description serve to explain the principle of the disclosure. In the drawings:

FIGS. 7A and 7B are diagrams of structures related to a guide access table (GAT) and a service mapping table (SMT) according to an embodiment of the present invention;

FIG. 8 is a diagram of a data structure related to the SGDD according to an embodiment of the present invention;

FIG. 9 is a diagram of a data structure related to the SGDU according to an embodiment of the present invention;

FIG. 10 is a diagram of a data structure related to description information according to an embodiment of the present invention;

FIGS. 17A to 17C are diagrams of a data structure related to interactive service information corresponding to a broadcast relevant reference time according to an embodiment of the present invention;

FIGS. 26A to 26D are diagrams of screen configurations of displaying updated broadcast relevant information when broadcast start/end time is different according to an embodiment of the present invention;

FIGS. 28A to 28D are diagrams of screen configurations of displaying updated broadcast relevant information when a broadcast start/end time and broadcast program title are different according to an embodiment of the present invention.

DETAILED DESCRIPTION

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts. The suffixes 'module' and 'unit' for the elements used in the following description are given or used in common by considering facilitation in writing this disclosure only but fail to have meanings or roles discriminated from each other.

The mobile terminals described in this disclosure can include a mobile phone, a smart phone, a laptop computer, a digital broadcast terminal, a personal digital assistant (PDA), a portable multimedia player (PMP), or a navigation system. Except a case applicable to a mobile terminal only, it is apparent to those skilled in the art that the configurations according to embodiments described in this disclosure are applicable to a stationary terminal, such as a digital television (TV) or a desktop computer.

Figure 1:
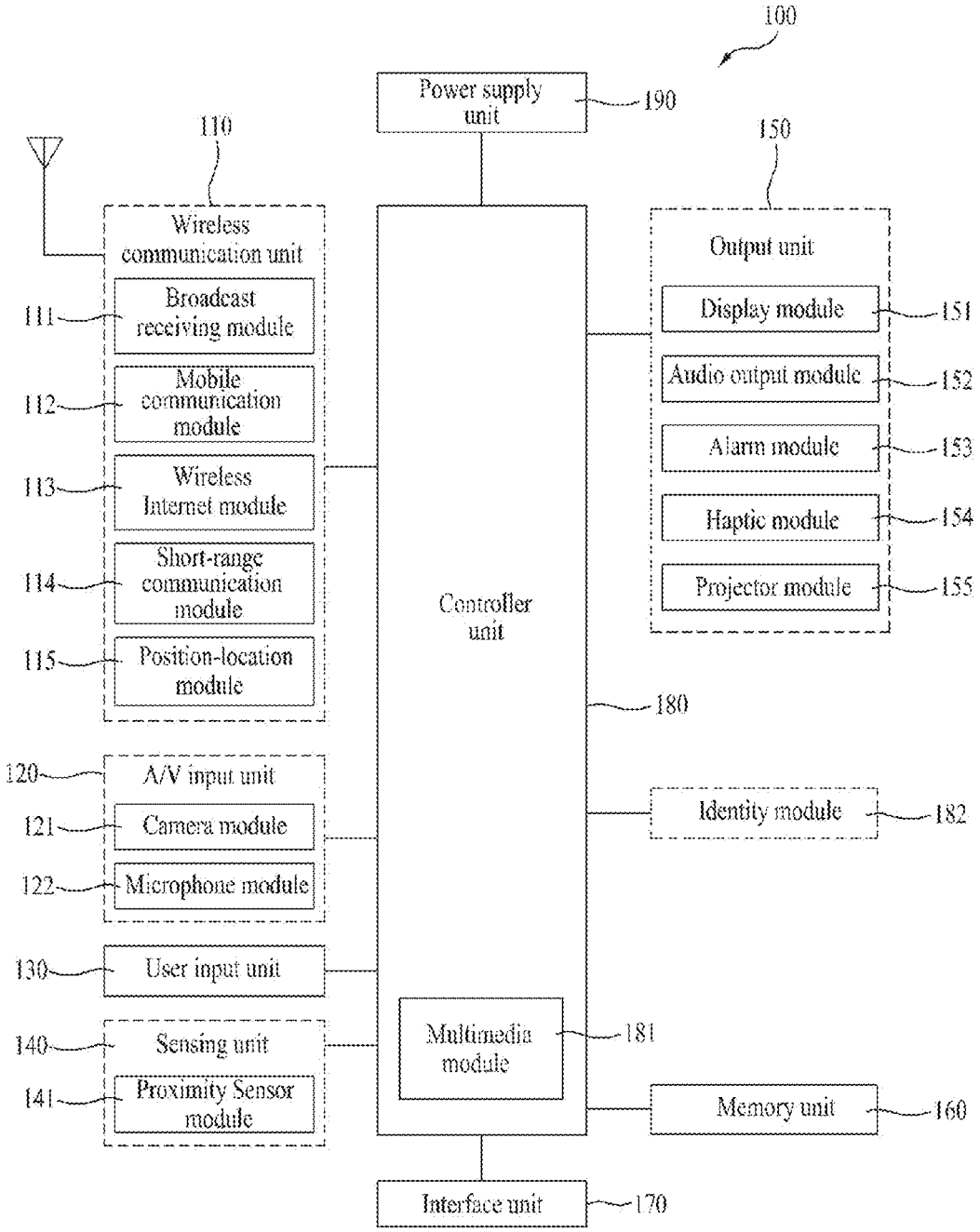
FIG. 1 is a block diagram of a mobile terminal according to an embodiment of the present invention.

FIG. 1 is a block diagram of a mobile terminal according to an embodiment of the present invention. Referring to FIG. 1, a mobile terminal 100 according to an embodiment of the present invention includes a wireless communication unit 110, an A/V (audio/video) input unit 120, a user input unit 130, a sensing unit 140, an output unit 150, a memory unit 160, an interface unit 170, a controller unit 180, an identity module 182 and a power supply unit 190. FIG. 1 shows the mobile terminal 100 having various components, but it is understood that implementing all of the illustrated components is not required. Greater or fewer number of components may alternatively be implemented.

The wireless communication unit 110 typically includes one or more components which permit wireless communication between the mobile terminal 100 and a wireless communication system or network within which the mobile terminal 100 is located. For example, the wireless communication unit 110 can include a broadcast receiving module 111, a mobile communication module 112, a wireless Internet module 113, a short-range communication module 114 and a position-location module 115.

The broadcast receiving module 111 receives a broadcast signal and/or broadcast associated information from an external broadcast managing server via a broadcast channel. The broadcast channel may include a satellite channel and a terrestrial channel.

The broadcast managing server generally refers to a server which generates and transmits the broadcast signal and/or the broadcast associated information or a server which is provided with a previously generated broadcast signal and/or broadcast associated information and then transmits the provided signal or information to a terminal. The broadcast signal may be implemented as a TV broadcast signal, a radio broadcast signal or a data broadcast signal. If desired, the broadcast signal may further include a broadcast signal combined with a TV or radio broadcast signal.

The broadcast associated information includes information associated with a broadcast channel, a broadcast program or a broadcast service provider. Additionally, the broadcast associated information can be provided via a mobile communication network. In this case, the mobile communication module 112 receives the broadcast associated information.

The broadcast associated information can be implemented in various forms. For example, the broadcast associated information may include an electronic program guide (EPG) of digital multimedia broadcasting (DMB) and electronic service guide (ESG) of digital video broadcast-handheld (DVB-H).

The broadcast receiving module 111 may be configured to receive broadcast signals transmitted from various types of broadcast systems. By nonlimiting example, such broadcasting systems may include digital multimedia broadcasting-terrestrial (DMB-T), digital multimedia broadcasting-satellite (DMB-S), digital video broadcast-handheld (DVB-H), the data broadcasting system known as media forward link only (MediaFLO®) and integrated services digital broadcast-terrestrial (ISDB-T).

Alternatively, the broadcast receiving module 111 can be configured suitable for other broadcasting systems as well as the above-explained digital broadcasting systems. The broadcast signal and/or broadcast associated information received by the broadcast receiving module 111 may be stored in a device, such as the memory unit 160.

The mobile communication module 112 transmits/receives wireless signals to/from one or more network entities (e.g., a base station, an external terminal or a server). Such wireless signals may represent audio, video, and data according to text/multimedia message transceivings.

The wireless Internet module 113 supports Internet access for the mobile terminal 100. This module may be internally or externally coupled to the mobile terminal 100. In this case, the wireless Internet technology can include Wireless LAN (WLAN), Wireless Fidelity (Wi-Fi), Wireless broadband (Wibro), World Interoperability for Microwave Access (Wimax), or High Speed Downlink Packet Access (HSDPA).

The short-range communication module 114 facilitates relatively short-range communications. Suitable technologies for implementing this module may include radio frequency identification (RFID), infrared data association (IrDA), ultra-wideband (UWB), as well as networking technologies commonly referred to as Bluetooth® and ZigBee®.

The position-location module 115 identifies or obtains location information of the mobile terminal 100. If desired, this module may be implemented with a global positioning system (GPS) module.

Referring to FIG. 1, the audio/video (A/V) input unit 120 is configured to provide audio or video signal input to the mobile terminal 100. The A/V input unit 120 includes a camera module 121 and a microphone module 122. The camera module 121 receives and processes image frames of still pictures or video, which are obtained by an image sensor in a video call mode or a photographing mode. The processed image frames can then be displayed on the display module 151.

The image frames processed by the camera module 121 can be stored in the memory unit 160 or can be externally transmitted via the wireless communication unit 110. Optionally, at least two of camera modules 121 can be provided in the mobile terminal 100 according to the usage environment.

The microphone module 122 receives an external audio signal while the mobile terminal 100 is in a particular mode, such as a phone call mode, a recording mode or a voice recognition mode. This audio signal is processed and converted into electric audio data. The processed audio data is transformed into a format transmittable to a mobile communication base station via the mobile communication module 112 when set in the phone call mode. The microphone module 122 typically includes assorted noise removing algorithms to remove noise generated when receiving the external audio signal.

The user input unit 130 generates input data responsive to user manipulation of an associated input device or devices. Examples of such devices include a keypad, a dome switch, a touchpad (e.g., static pressure/capacitance), a jog wheel, or a jog switch.

The sensing unit 140 provides sensing signals for controlling operations of the mobile terminal 100 using status measurements of various aspects of the mobile terminal 100. For example, the sensing unit 140 may detect an open/close status of the mobile terminal 100, relative positioning of components (e.g., a display and keypad) of the mobile terminal 100, a change of position of the mobile terminal 100 or a component of the mobile terminal 100, a presence or absence of user contact with the mobile terminal 100, orientation of the mobile terminal 100, or acceleration/deceleration of the mobile terminal 100.

For example, when the mobile terminal 100 is configured as a slide-type mobile terminal, the sensing unit 140 may sense whether a sliding portion of the mobile terminal 100 is open or closed. Other examples may include the sensing unit 140 sensing the presence or absence of power provided by the power supply unit 190, the presence or absence of a coupling or other connection between the interface unit 170 and an external device. Lastly, the sensing unit 140 can include a proximity sensor module 141.

The output unit 150 generates an output relevant to the senses of sight, hearing, or touch. The output unit 150 can include at least the display module 151, an audio output module 152, an alarm unit 153, a haptic module 154, or a projector module 155.

The display module 151 is typically implemented to visually display or output information associated with the mobile terminal 100. For example, if the mobile terminal is operating in the phone call mode, the display will generally provide a user interface (UI) or graphical user interface (GUI) which includes information associated with placing, conducting, and terminating a phone call. In another example, if the mobile terminal 100 is in a video call mode or a photographing mode, the display module 151 may additionally or alternatively display images which are associated with either of these two modes, the UI or the GUI.

The display module 151 may be implemented using known display technologies including at least a liquid crystal display (LCD), a thin film transistor-liquid crystal display (TFT-LCD), an organic light-emitting diode display (OLED), a flexible display, or a three-dimensional (3D) display, for example. The mobile terminal 100 may include one or more of such displays. Some of the displays can be implemented in a transparent or optical transmittive type, such as a transparent OLED (TOLED).

A rear configuration of the display module 151 can be implemented in the optical transmittive type as well. In this configuration, a user can see an object in a rear section of the mobile terminal 100 via the area occupied by the display module 151.

At least two of display modules 151 can be provided in accordance with the implemented configuration of the mobile terminal 100. For example, a plurality of display modules can be arranged on a single face of the mobile terminal 100 in a manner of being spaced apart from each other or being built in one body of the mobile terminal 100. Alternatively, a plurality of display modules can be arranged on different faces of the mobile terminal 100.

In case the display module 151 and the sensing unit 140 detecting a touch action (hereinafter "touch sensor") configures a mutual layer structure (hereinafter "touchscreen"), the display module 151 can be used as an input device as well as an output device. In this case, the touch sensor can be configured as a touch film, a touch sheet, or a touchpad.

The touch sensor can be configured to convert a pressure applied to a specific portion of the display module 151 or a variation of a capacitance generated from a specific portion of the display module 151 to an electric input signal. Moreover, the touch sensor may detect a pressure of a touch as well as a touched position or size.

If a touch input is made to the touch sensor, signal(s) corresponding to the touch is transferred to a touch controller. The touch controller processes the signal(s) and then transfers the processed signal(s) to the controller unit 180. Therefore, the controller unit 180 determines whether a prescribed portion of the display module 151 is touched.

Referring to FIG. 1, a proximity sensor module 141 can be provided to an internal area of the mobile terminal 100 enclosed by the touchscreen or around the touchscreen. The proximity sensor module 141 detects a presence or non-presence of an object approaching a prescribed detecting surface or an object existing around the proximity sensor using an electromagnetic field strength or infrared ray without mechanical contact. Hence, the durability and utility of proximity sensor module 141 is greater than that of a contact type sensor.

The proximity sensor module 141 can include at least a transmittive photoelectric sensor, a direct reflective photoelectric sensor, a mirror reflective photoelectric sensor, a radio frequency oscillation proximity sensor, an electrostatic capacity proximity sensor, a magnetic proximity sensor, or an infrared proximity sensor. In case the touchscreen includes the electrostatic capacity proximity sensor, it can be configured to detect the proximity of a pointer using a variation in an electric field according to the proximity of the pointer. In this case, the touchscreen or touch sensor can be classified as the proximity sensor module 141.

Generally, an action related to a pointer approaching without contacting with the touchscreen to be recognized as located on the touchscreen can be referred to as a 'proximity touch.' Additionally, an action related to a pointer actually touching the touchscreen can be referred to as a 'contact touch.' The position on the touchscreen proximity-touched by the pointer means the position of the pointer which vertically opposes the touchscreen when the pointer performs the proximity touch.

The proximity sensor module 141 detects a proximity touch and a proximity touch pattern (e.g., a proximity touch distance, a proximity touch duration, a proximity touch position, or a proximity touch shift state). Thus, information corresponding to the detected proximity touch action and the detected proximity touch pattern can be output to the touchscreen.

The audio output module 152 functions in various modes including at least a call-receiving mode, a call-placing mode, a recording mode, a voice recognition mode, or a broadcast reception mode to output audio data which is received from the wireless communication unit 110 or stored in the memory unit 160. During operation, the audio output module 152 outputs audio relating to a particular function (e.g., call received or message received). The audio output module 152 is typically implemented using one or more speakers, buzzers, other audio producing devices, or a combination thereof.

The alarm module 153 can output a signal for announcing the occurrence of a particular event associated with the mobile terminal 100. Typical events include a call received event, a message received event and a touch input received event. The alarm module 153 can output a signal for announcing the event occurrence by way of vibration as well as a video or audio signal. The video or audio signal can be output via the display module 151 or the audio output module 152. Hence, the display module 151 or the audio output module 152 can be characterized as part of the alarm module 153.

The haptic module 154 generates various tactile effects that can be sensed by a user. Vibration is one of the tactile effects generated by the haptic module 154. Strength and pattern of the vibration generated by the haptic module 154 can be controlled. For example, different vibrations can be output such that the vibrations are synthesized together or output in sequence.

The haptic module 154 can generate various tactile effects as well as the vibration. For example, the haptic module 154 generates the effect attributed to the arrangement of pins vertically moving against a contact skin surface, the effect attributed to the injection/suction power of air though an injection/suction hole, the effect attributed to the skim over a skin surface, the effect attributed to the contact with an electrode, the effect attributed to the electrostatic force, or the effect attributed to the representation of hold/cold sense using an endothermic or exothermic device.

The haptic module 154 can be implemented to enable a user to sense the tactile effect through a muscle sense of a finger or an arm as well as to transfer the tactile effect through a direct contact. Optionally, at least two haptic modules 154 can be provided to the mobile terminal 100 in accordance with the corresponding configuration type of the mobile terminal 100.

The projector module 155 performs an image projector function using the mobile terminal 100. For example, the projector module 155 can display an image according to a control signal of the controller unit 180. The image may be identical to or partially different at least from the image displayed on the display module 151, an external screen or a wall.

In particular, the projector module 155 can include a light source (not shown) generating light (e.g., laser) for projecting an image externally, an image producing means (not shown) for producing an image to be output externally using the light generated from the light source, and a lens (not shown) for enlarging the image for output externally in a predetermined focus distance. Also, the projector module 155 can further include a device (not shown) for adjusting an image projected direction by mechanically moving the lens or the projector module 155 in its entirety.

The projector module 155 can be classified into a cathode ray tube (CRT) module, a liquid crystal display (LCD) module, or a digital light processing (DLP) module according to a device type of a display means. In particular, the DLP module is operated by enabling the light generated from the light source to reflect on a digital micro-mirror device (DMD) chip. As such, it can be advantageous for the downsizing of the projector module 151.

Preferably, the projector module 155 can be provided in a length direction of a lateral, front or backside direction of the mobile terminal 100. It is understood that the projector module 155 can be provided to any portion of the mobile terminal 100 according to the necessity thereof.

The memory unit 160 is generally used to store various types of data to support the processing, control, and storage requirements of the mobile terminal 100. Examples of such data include program instructions for applications operating on the mobile terminal 100 such as contact data, phonebook data, messages, audio, still pictures, or moving pictures.

Additionally, a recent use history or a cumulative use frequency of each data (e.g., use frequency for each phonebook, each message or each multimedia) can be stored in the memory unit 160. Moreover, data for various patterns of vibration and/or sound output in response to a touch input to the touchscreen can be stored in the memory unit 160.

The memory unit 160 may be implemented using any type or combination of suitable volatile and non-volatile memory or storage devices including a hard disk, a random access memory (RAM), a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk, a multimedia card micro type memory, card-type memory (e.g., SD memory, XD memory.), or other similar memory or data storage device. Additionally, the mobile terminal 100 can operate in association with a web storage device for performing a storage function of the memory unit 160 on the Internet. The interface unit 170 is often implemented to couple the mobile terminal 100 with external devices. The interface unit 170 can receive data or power from the external devices. The interface unit 170 then transfers the received data or power to the respective elements of the mobile terminal 100. Alternatively, the interface unit 170 enables data within the mobile terminal 100 to be transferred to the external devices.

The interface unit 170 may be configured using at least a wired or wireless headset port, an external charger port, a wired or wireless data port, a memory card port, a port for coupling to a device having an identity module, audio input or output ports, video input or output ports, or an earphone port.

The identity module 182 is an electronic module for storing various kinds of information in authenticating a use authority of the mobile terminal 100 and can include at least a User Identify Module (UIM), a Subscriber Identify Module (SIM), or a Universal Subscriber Identity Module (USIM). A device having the identity module 182 (hereinafter "identity device") can be manufactured as a smart card. Therefore, the identity device can be connected to the mobile terminal 100 via a corresponding port.

When the mobile terminal 110 is connected to an external cradle, the interface unit 170 becomes a passage for supplying the mobile terminal 100 with power from the external cradle or a passage for delivering various command signals input from the external cradle by a user to the mobile terminal 100. Each of the various command signals input from the external cradle or power can operate as a signal enabling the mobile terminal 100 to recognize that it is correctly loaded in the external cradle.

The controller unit 180 typically controls the overall operations of the mobile terminal 100. For example, the controller unit 180 performs the control and processing associated with voice calls, data communications, or video calls. The controller unit 180 may include a multimedia module 181 that provides multimedia playback. The multimedia module 181 may be configured as part of the controller unit 180, or implemented as a separate component. Moreover, the controller unit 180 can perform a pattern recognizing process for recognizing a writing input and a picture drawing input carried out on the touchscreen as characters or images.

The power supply unit 190 provides power required by the various components for the mobile terminal 100. The power may be internal power, external power, or a combination thereof.

Various embodiments described herein may be implemented in a computer-readable medium using computer software, hardware, or some combination thereof, for example. For a hardware implementation, the embodiments described herein may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a selective combination thereof. Such embodiments may also be implemented by the controller unit 180.

For a software implementation, the embodiments described herein may be implemented with separate software modules, such as procedures and functions, each of which perform one or more of the functions and operations described herein. The software codes can be implemented with a software application written in any suitable programming language and may be stored in the memory unit 160, and executed by the controller unit 180.

Figure 2:
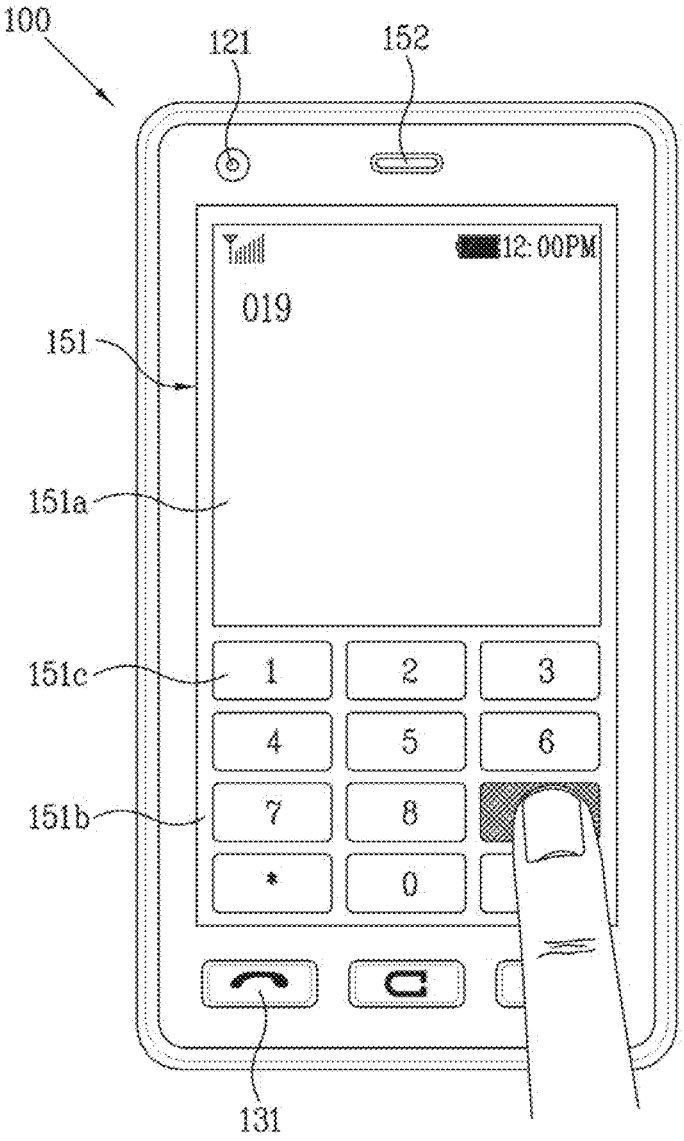
FIG. 2 is a diagram of a front-side of a mobile terminal for explaining an operational status of the mobile terminal according to an embodiment of the present invention.

An interconnected operational mechanism between the display module 151 and the touchpad (not shown) is explained with reference to FIG. 2. FIG. 2 is a diagram of a front-side of the mobile terminal 100 for explaining an operational status of the mobile terminal according to an embodiment of the present invention.

Various kinds of visual information can be displayed on the display module 151. This information, for example, can be displayed using characters, numerals, symbols, graphics, or icons.

In order to input the information in the mobile terminal 100, at least one of the characters, numerals, symbols, graphics and icons is represented as a single predetermined array to be implemented in a keypad formation. This keypad formation can be referred to as a "soft key."

FIG. 2 depicts a touch applied to a soft key input through a front face of the mobile terminal 100. The display module 151 is operable through an entire area or a particular number of regions. In the latter case, the particular number of regions can be configured to be interoperable.

For example, an output window 151*a* and an input window 151*b* are displayed on the display module 151. A soft key 151*c* representing a numerical digit for inputting a phone number is displayed on the input window 151*b*. If the soft key 151*c* is touched, a numerical digit corresponding to the touched soft key is displayed on the output window 151*a*. If a first manipulating unit 131 is manipulated, a call connection using the phone number displayed on the output window 151*a* is attempted.

Figure 3A:
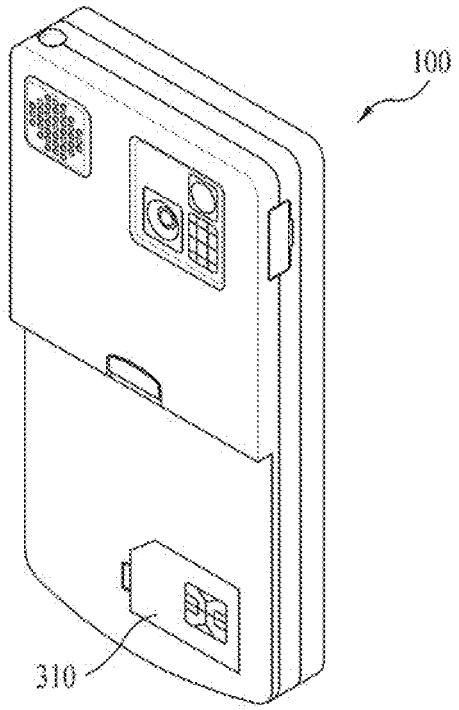
FIGS. 3A and 3B are perspective diagrams of a backside of a mobile terminal according to an embodiment of the present invention.
Figure 3B:
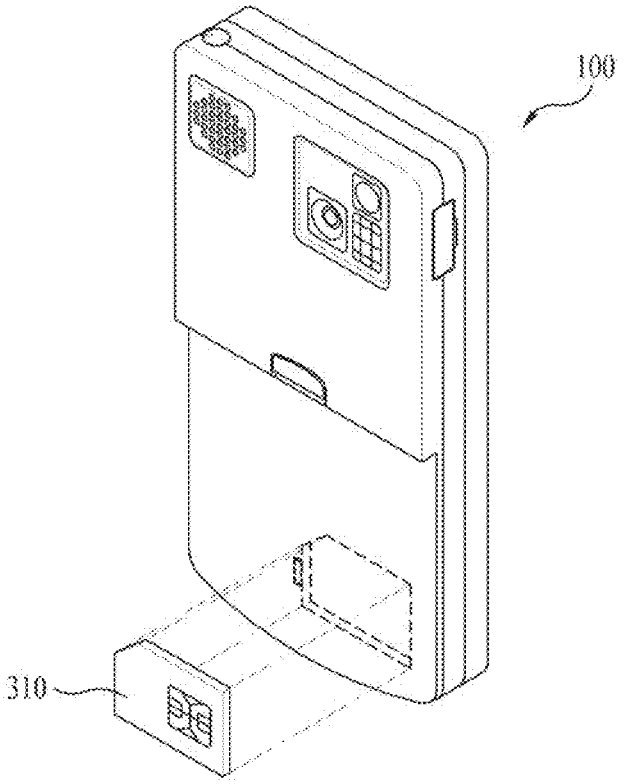

FIGS. 3A and 3B are perspective diagrams of a backside of the mobile terminal 100 according to an embodiment of the present invention, which show an identity device 310 loaded in or unloaded from the mobile terminal 100 via the identity unit 182. In this case, the identity device 310 can include a SIM card, for example.

Referring to FIG. 3A and FIG. 3B, the identity device 310 is detachably provided to the mobile terminal 100. Therefore, an old identity device can be replaced by a new identity device in the mobile terminal 100.

The identity device 310 can be loaded in the mobile terminal 100 via the identity unit 182 in a manner of being connected to the interface unit 170. Alternatively, the identity device 310 can be loaded in the mobile terminal 100 in a manner of being connected to a connector separately provided for the connection to the identity device 310. The mobile terminal 100 authenticates overall use authority over the mobile terminal 100 or can authenticate broadcast view or purchase authority using the identity device 310.

A connecting means (not shown) for connecting the identity device 310 and the mobile terminal 100 together can be provided to at least a backside, a lateral side, or a front side of the mobile terminal 100. Although FIG. 3A and FIG. 3B show the mechanism of loading or unloading the identity device 310 in or from the mobile terminal 100, it is apparent that an embodiment of the present invention is applicable to a mobile terminal not provided with a detachable identity device.

Generally, a broadcast provider can mean a broadcast service provider providing broadcast contents via at least one broadcast channel. In other words, when a broadcast service provider provides first to third broadcast channels, the broadcast provider can become the broadcast service provider (e.g., MBN) for each of the first to third broadcast channels (e.g., CH MBN-News, CH MBN-Drama, CH MBN-Sports). For example, according to one of mobile broadcasting standards (e.g., ATSC-M/H), a broadcast provider can be named a provider and a broadcast channel can be named a service.

Broadcast relevant information mentioned in this disclosure may include schedule information on either broadcast content or a broadcast program, content information, preview information, or interactive service information, and can include broadcast guide information. Moreover, channel connection information (FIG. 7A and FIG. 7B) and broadcast guide reception relevant information (FIG. 8) may be necessary as information for receiving the broadcast guide information.

For example, according to the ATSC-M/H standard, the channel connection information can be called a guide access table (GAT) or a service mapping table (SMT). The broadcast guide reception relevant information can be called a service guide delivery descriptor (SGDD). Lastly, the broadcast guide information can be called a service guide delivery unit (SGDU).

Prior to the detailed description of a broadcast controlling method according to an embodiment of the present invention, a broadcast frequency band allocation and a structure of an ensemble provided in a mobile region are described in detail as follows. It is assumed that there is a plurality of broadcast providers that provide the mobile terminal 100 with broadcast contents and broadcast relevant information.

For example, broadcast frequency bands can be divided into a broadcast frequency band (hereinafter "terrestrial region") for a terrestrial broadcast targeting a stationary television and a broadcast frequency region (hereinafter "mobile region") for a mobile broadcast targeting a mobile television. Additionally, it is assumed that one broadcast provider can provide both a terrestrial broadcast and a mobile broadcast.

Figure 4A:
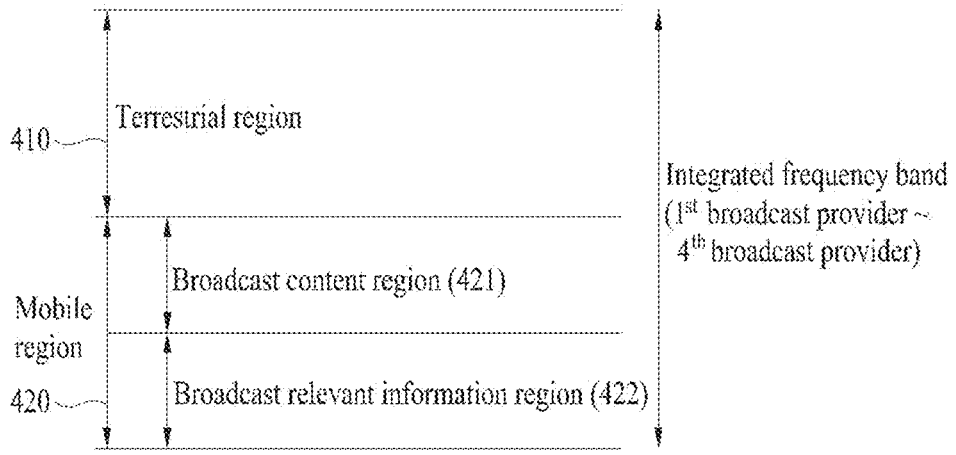
FIGS. 4A to 4D are diagrams of structures for allocating broadcast frequency regions to a plurality of broadcast providers according to an embodiment of the present invention.

FIGS. 4A to 4D are diagrams of structures for allocating broadcast frequency regions to a plurality of broadcast providers according to an embodiment of the present invention. Referring to FIG. 4A, a broadcast frequency band is divided into a terrestrial region 410 and a mobile region 420. Since the mobile region 420 is an integrated frequency band in common with all broadcast providers, such as $1^{st}$ to $4^{th}$ broadcast providers, the mobile region 420 is not individually allocated to each broadcast provider. This can mean that all broadcast providers share the mobile region 420 with each other.

Figure 4B:
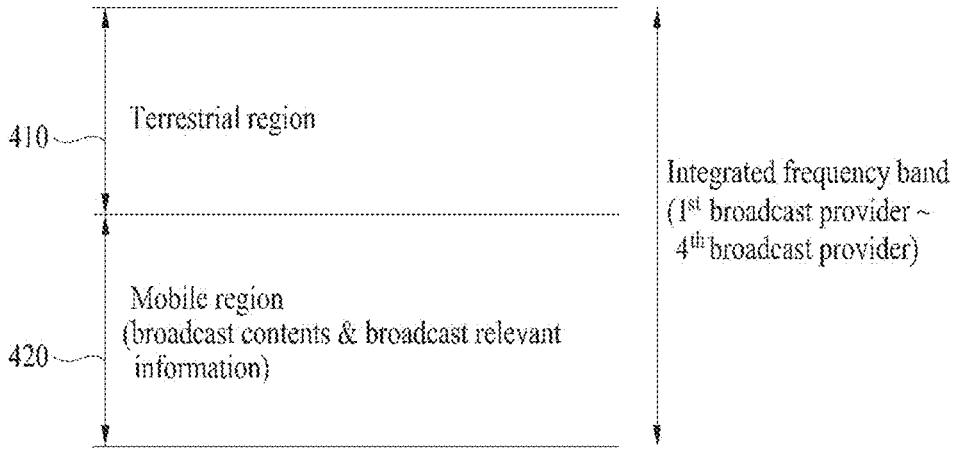

Referring to FIG. 4A, the mobile region 420 is operated by being divided into a broadcast content region 421 and a broadcast relevant information region 422. Referring to FIG. 4B, the broadcast content region and the broadcast relevant information region can operate together in the mobile region 420.

In particular, FIG. 4A shows that all broadcast providers provide a broadcast signal on a specific broadcast channel via the broadcast content region 421 and can provide broadcast relevant information to each of the broadcast providers individually, whereas FIG. 4B shows that all broadcast providers provide the same content and information together.

The broadcast content region 421 means a broadcast frequency band for receiving a broadcast signal corresponding to a broadcast program provided on a broadcast channel by a broadcast provider. The broadcast relevant information region 422 can mean a broadcast frequency band for receiving broadcast relevant information provided by a broadcast provider.

Figure 4C:
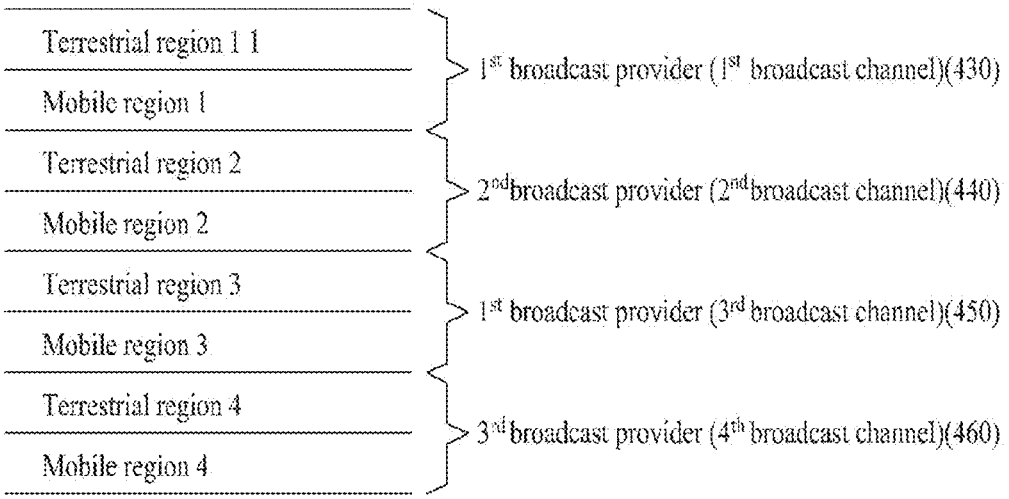
Figure 4D:
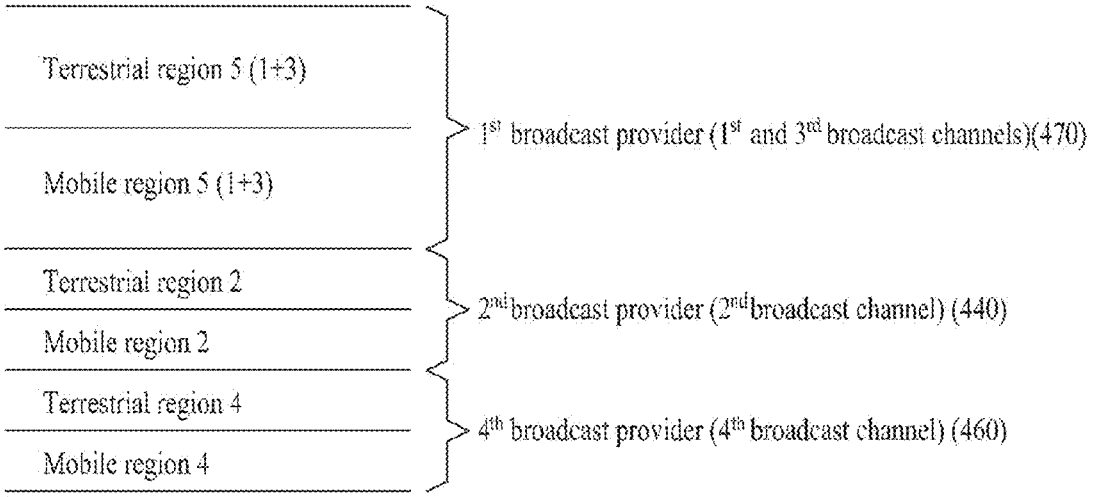

As illustrated in FIG. 4C, a broadcast frequency band can be individually allocated to each broadcast channel (e.g., el. 430, 440, 450, 460). As illustrated in FIG. 4D, a broadcast frequency band can be individually allocated to each of the $1^{st}$ to $4^{th}$ broadcast providers corresponding to entire broadcast providers (e.g., el. 440, 460, 470).

For example, assuming that a $1^{st}$ broadcast provider operates $1^{st}$ and $3^{rd}$ broadcast channels, the broadcast frequency band is allocated differently between the first broadcast provider (e.g., $1^{st}$ broadcast channel) 430 and the first broadcast provider (e.g., el. 450) according to allocation per broadcast channel as illustrated in FIG. 4C. On the other hand, the broadcast frequency band can be allocated to the $1^{st}$ broadcast provider 470 handling the $1^{st}$ and $3^{rd}$ broadcast channels which is allocated to the broadcast provider, as illustrated in FIG. 4D.

Moreover, each broadcast frequency band can be divided into a terrestrial region and a mobile region. Thus, a broadcast content region and a broadcast relevant information region can be individually (FIG. 4A) or integratedly (FIG. 4B) operated within the mobile region.

Figure 5:
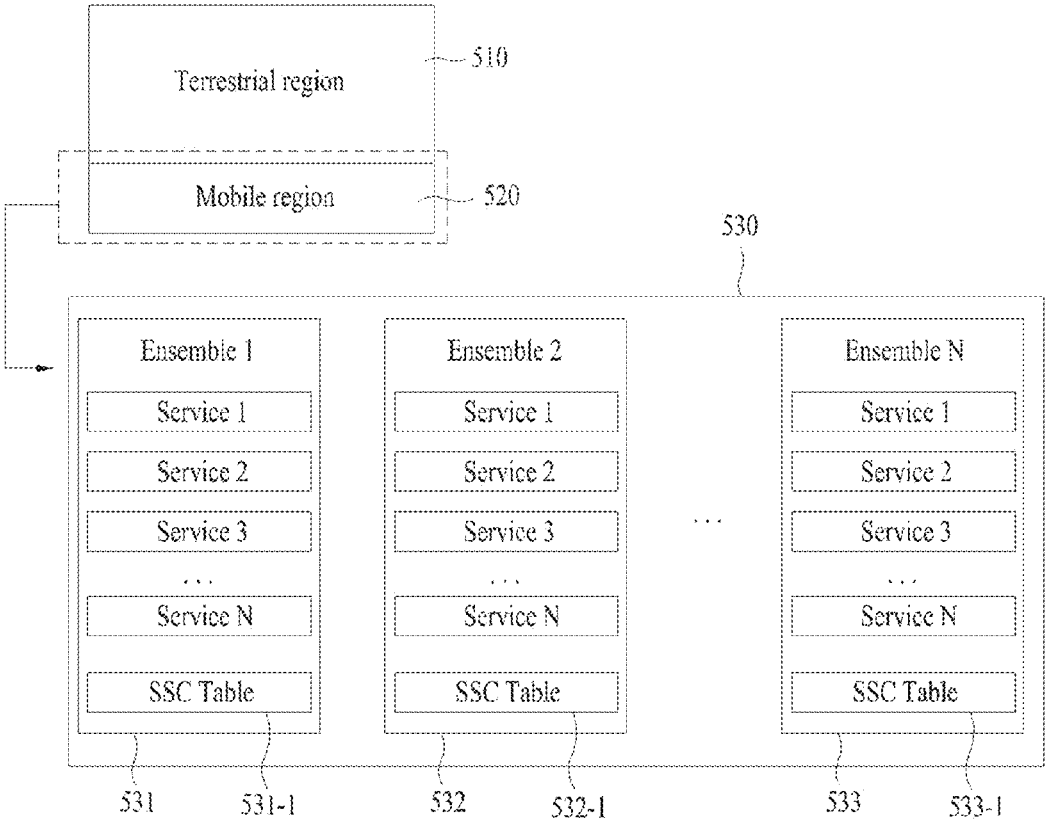
FIG. 5 is a block diagram of an ensemble structure provided in a mobile region of a broadcast frequency region of a specific broadcast provider according to an embodiment of the present invention.

FIG. 5 is a block diagram of an ensemble structure provided in a mobile region of a broadcast frequency region of a specific broadcast provider according to an embodiment of the present invention. As mentioned in the foregoing description in relation to FIGS. 4A to 4D, a broadcast frequency region can be divided into a terrestrial region 510 and a mobile region 520. An Ensemble mentioned in this disclosure is a set of at least one broadcast channel or service provided by at least one broadcast provider and can include a table containing a plurality of broadcast channels or services and configuration information on each of the plurality of broadcast channels included in the corresponding ensemble.

In the mobile region 520, at least one or more ensembles 531 to 533 can be provided. Each of the ensembles 531 to 533 can include at least one broadcast channel or service provided to a corresponding broadcast provider and configuration information of each broadcast channel. Particularly, at least one broadcast provider can be allocated to one ensemble.

The configuration information of the broadcast channel can be obtained from a scanning process of the corresponding ensemble. For example, according to the ATSC-MH standard, configuration information of a broadcast channel included in an ensemble can be named a service signaling channel table (SSC-Table). For example, the SSC-Table can include GAT, SMT, SLT, or CIT.

Referring to the first ensemble 531 of FIG. 5, the first ensemble 531 can include $1^{st}$ to $N^{th}$ services (e.g., Services 1 to N) and a configuration table, such as SSC-Table 531-1. For example, the $1^{st}$ to $N^{th}$ services (e.g., Services 1 to N) can provide broadcast channels (e.g., MBN-News, MBN-Sports, MBS-Drama, MBS-Movie) provided by the at least one or more broadcast providers (e.g., MBN, MBS) allocated to the first ensemble 531.

Alternatively, broadcast guide information including broadcast guide reception relevant information of the at least one broadcast provider allocated to the first ensemble 531 can be provided via one service. The configuration table 531-1 (e.g., SSC-Table) can provide channel connection information per broadcast provider (e.g., GAT), decoding information (e.g., SMT) of services contained in the first ensemble 531.

Moreover, according to the ensemble configuration in FIG. 5, a specific ensemble of the plurality of ensembles can be allocated separately to provide broadcast relevant information. Additionally, the specific ensemble can provide broadcast relevant information on services provided by the rest of the ensembles.

In the following description, structures of per-broadcast provider channel connection information, broadcast guide reception relevant information and broadcast guide information according to an embodiment of the present invention are explained with reference to FIGS. 6 to 9. For clarity and convenience of the following description, data structures of per-broadcast provided channel connection information (e.g., GAT, SMT), broadcast guide reception relevant information (e.g., SGDD) and broadcast guide information (e.g., SGDU), which are used by ATSC-MH, are respectively described.

Figure 6:
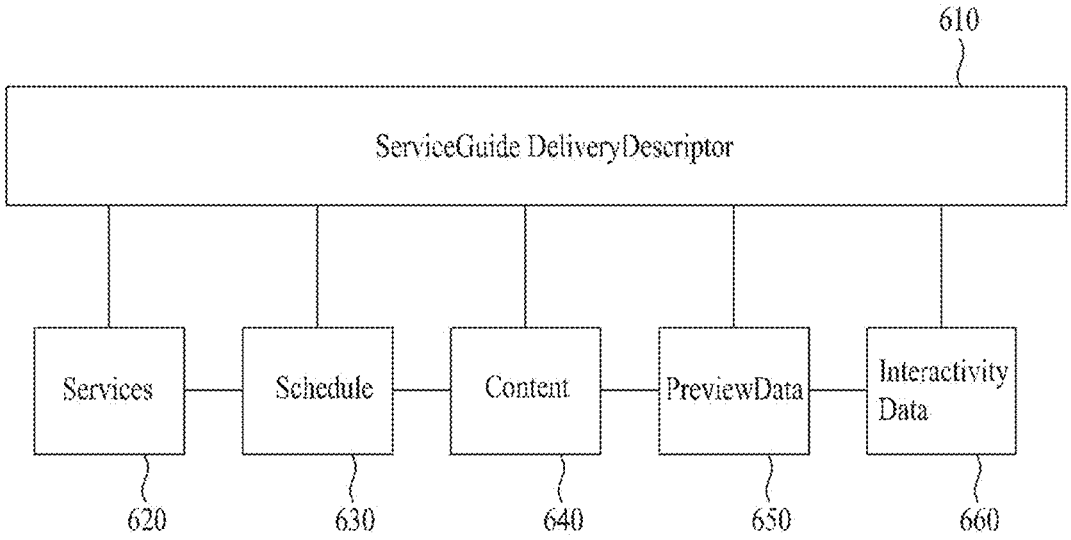
FIG. 6 is a diagram of structures related to a service guide delivery descriptor (SGDD) and a service guide delivery unit (SGDU) according to an embodiment of the present invention.

FIG. 6 is a diagram of structures related to a service guide delivery descriptor (SGDD) and a service guide delivery unit (SGDU) according to an embodiment of the present invention. Referring to FIG. 6, broadcast information can include an SGDD 610 containing channel connection information of a channel providing an SGDU and at least one or more SGDUs 620 to 660 provided per fragment. In this case, the fragment can mean an identifier for identifying a content or type of data contained in the SGDU.

In particular, the SGDUs 620 to 660 can include at least an SGDU 620 having a data type of service, an SGDU 630 having a data type of schedule data, an SGDU 630 having a data type of content data, an SGDU 650 having a data type of preview data, or an SGDU 660 having a data type of interactive data.

In particular, the SGDU 620 has matching information with identification information set for each of the other SGDUs 630 to 660 and information necessary to be output to each of the other SGDUs 630 to 660. Therefore, the mobile terminal 100 checks the matching information corresponding to the identification information of a specific SGDU from the SGDU 620 and is then able to output the specific SGDU using the information linked to the checked matching information.

FIGS. 7A and 7B are diagrams of structures related to a guide access table (GAT) and a service mapping table (SMT) according to an embodiment of the present invention. Referring to FIG. 7A, a GAT can contain identification information 701 to 703 relating to a corresponding broadcast provider.

For example, the identification information can contain a broadcast provider name 703 (e.g., SG_provider_name), a service ID 701 (e.g., MH_service_Id) and an announcement channel information 702 (e.g., announcement_channel_tsI). In this case, a broadcast provider having a broadcast provider name contained in the GAT of FIG. 7A can be regarded as a broadcast provider that provides corresponding broadcast guide information.

Referring to FIG. 7B, the mobile terminal checks a service ID 711 (e.g., MH_service_Id) matching the service ID 701 contained in the GAT of FIG. 7A and extracts channel connection information of the SGDD linked to the checked service ID 711. For example, the channel connection information of the SGDD extracted from the SMT can include a network address 720 (e.g., source_IP_address, MH_service_destination_IP_address) and a component address 730 (e.g., component_destination_UDP_port_num, component_destination_IP_address).

The mobile terminal 100 opens a channel or a session providing the corresponding SGDD using the announcement channel information 702 (e.g., anouncement_channel_tsI) included in the GAT and the first IP address information (e.g., source_IP_address, component_destination_IP_address) contained in the SMT. If the first IP address information does not exist, then the mobile/handheld IP address information (e.g., MH_service_destination_IP_address) is used, which allows the mobile terminal 100 to receive the SGDD via the open channel.

FIG. 8 is a diagram of a data structure related to the SGDD according to an embodiment of the present invention. Referring to FIG. 8, the SGDD is information necessary for receiving the SGDU which can include at least SGDD identification information 810, descriptor entry information 820, transport information 830 of a channel providing the SGDU, or fragment type information 840 of a fragment set for the SGDU. The mobile terminal 100 checks the "ServiceGuideDeliveryUnit" field information 822 contained in the descriptor entry information 820 and is then able to check a fragment that was set for the corresponding SGDU using the fragment type information 840 corresponding to the checked "ServiceGuideDeliveryUnit" field information 822.

Referring to the fragment type information 840, if fragment type=1, it can be observed that a service fragment is set in a corresponding SGDU, for example. In another example, if fragment type=2, it can be observed that a content fragment is set in a corresponding SGDU. In still another example, if fragment type=3, it can be observed that a schedule fragment is set in a corresponding SGDU. In yet another example, if fragment type=8, it can be observed that a preview data fragment is set in a corresponding SGDU. Lastly, if fragment type=9, it can be observed that an interactivity data fragment is set in a corresponding SGDU, for example.

The mobile terminal 100 opens a channel or a session to provide a corresponding SGDU using data included in the transport information 830 which provides the corresponding SGDU and is then able to receive the corresponding SGDU via the open channel. For example, the transport information 830 can contain an IP address (ipAddress), port information (e.g., port) and session information (e.g., transmissionSessionID) of the corresponding SGDU.

FIG. 9 is a diagram of a data structure related to the SGDU using the transport information 830 of the SGDD according to an embodiment of the present invention. Referring to FIG. 9, an SGDU can contain a corresponding fragment type 901 (e.g., fragmentType) and a broadcast guide information 902 (e.g., XML Fragment) encapsulated to be suitable for the corresponding fragment type. Therefore, the mobile terminal 100 opens the encapsulated broadcast guide information 902 suitable for a corresponding data type and is then able to extract broadcast guide information to provide substantially.

Meanwhile, if fragment type information of the SGDU is not separately provided using the SGDD and SGDU, the mobile terminal 100 can check a data type of the SGDU by checking substantial broadcast guide information (e.g., XML fragment 902) contained in the SGDU.

According to an embodiment of the present invention, the mobile terminal 100 can receive description information related to a specific broadcast program via a specific broadcast channel when receiving the specific broadcast program via the specific broadcast channel.

FIG. 10 is a diagram of a data structure related to description information according to an embodiment of the present invention. For example, the description information according to the ATSC-MH standard can contain a current program descriptor. Referring to FIG. 10, a current program descriptor is information related to a corresponding broadcast program and that contains at least a broadcast start time 1001 (e.g., current program start time), a broadcast end time (e.g., current program end time) (not shown), a broadcast duration 1002 (e.g., current program duration), or a broadcast program title 1003 (e.g., title text).

Moreover, if a currently received broadcast program is switched from a first broadcast program to a second broadcast program, the mobile terminal 100 can receive description information corresponding to the second broadcast program. Accordingly, the description information can be changed according to the broadcast program currently being received.

In the following description, a method of controlling a broadcast in a mobile terminal according to an embodiment of the present invention is explained in detail with reference to the accompanying drawings. For example, a process for searching and outputting specific broadcast relevant information using a broadcast relevant reference time when receiving a specific broadcast program is explained with reference to FIG. 11.

Figure 11:
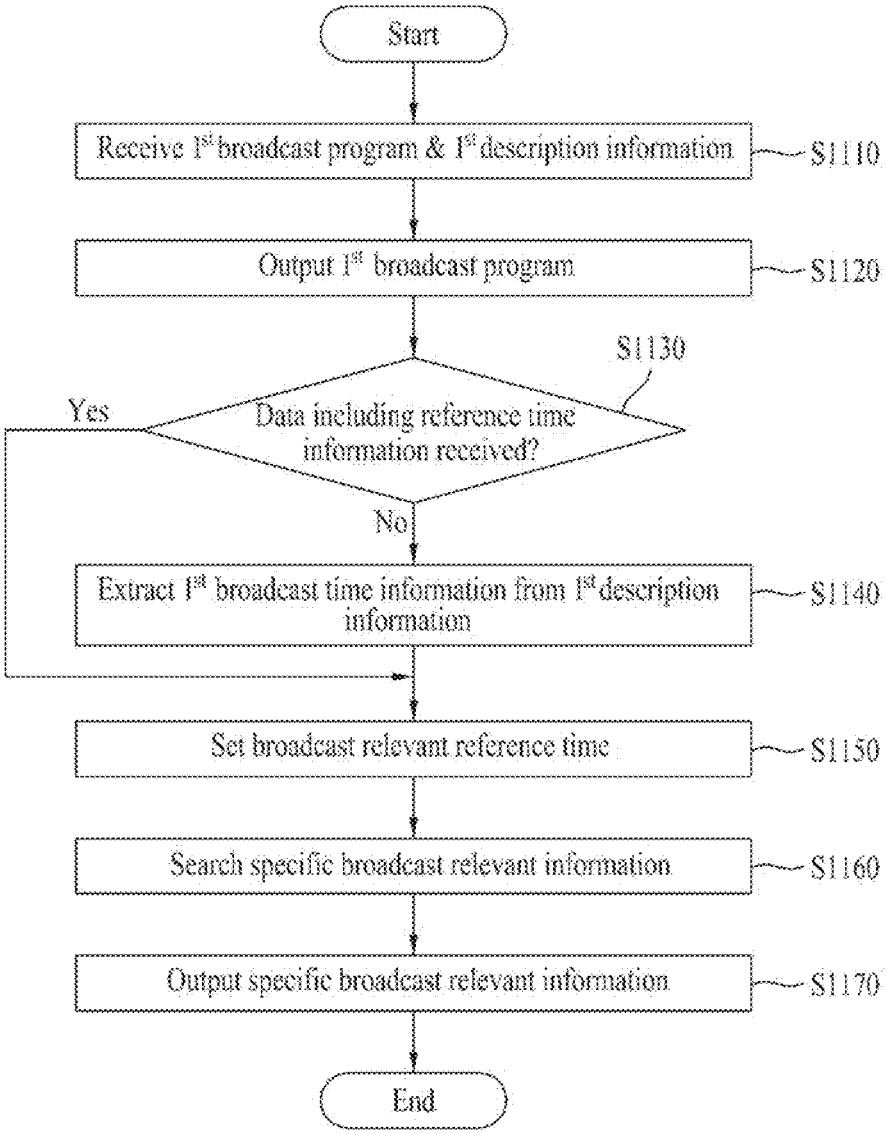
FIG. 11 is a flowchart of a broadcast controlling method of a mobile terminal according to an embodiment of the present invention.

FIG. 11 is a flowchart of a broadcast controlling method of a mobile terminal according to an embodiment of the present invention. Referring to FIG. 11, the mobile terminal 100 receives a first broadcast program of a first broadcast channel and first description information related to the first broadcast program via the wireless communication unit 110 [S1110]. In particular, the first broadcast program and the first description information can be received using the broadcast receiving module 111.

The mobile terminal 100 can receive the first broadcast program and the first description information via a frequency band allocated to the first broadcast channel. For example, the first description information can include at least a broadcast start/end time 1001, a broadcast duration 1002, or a program title 1003 of the first broadcast program (FIG. 10). Therefore, changing the first broadcast program received in the receiving step S1110 also changes the first description information. Moreover, the first description information received by the mobile terminal 100 can be stored in the memory unit 160.

According to the ATSC-MH standard, the first broadcast channel can include at least one or more services in a specific ensemble (FIG. 5). The mobile terminal 100 via the controller unit 180 controls the output of the first received broadcast program via the output unit 150 [S1120]. For example, the first broadcast program can contain audio data that is output via the audio output module 152 and video data that is output via the display module 151.

The mobile terminal 100 via the control of the controller unit 180 determines whether or not data containing reference time information (hereinafter "reference time data") is received after performing the receiving step and the outputting step [S1130]. In this case, the reference time data is data containing current time information related to broadcast reception or output and can be provided with a predetermined time periodicity from a network. For example, according to the ATSC-MH standard, reference time information can be provided a via network time protocol (NTP) packet. In this case, the NTP packet can be provided by an ensemble unit.

The mobile terminal 100 searches broadcast relevant information previously stored in the memory unit 160 for specific broadcast relevant information corresponding to a broadcast relevant reference time and can set the broadcast relevant reference time to a current time contained in the reference time data.

Upon detecting that data containing reference time data is not received, the mobile terminal 100 extracts first broadcast time information from the first received description information under the control of the controller unit 180 [S1140]. For example, the controller unit 180 can extract a broadcast start/end time 1001 or broadcast duration 1002 of the first broadcast program as the first broadcast time information from the first description information (FIG. 10).

Subsequently, under the control of the controller unit 180, the mobile terminal 100 sets a broadcast relevant reference time using the extracted first broadcast time information [S1150]. For example, the mobile terminal 100 can set the broadcast relevant reference time to a specific time selected by a user from times settable as the broadcast relevant reference time or a prescribed time randomly selected by the controller unit 180.

Under the control of the controller unit 180, the mobile terminal searches the broadcast relevant information stored in the memory unit 160 for specific broadcast relevant information corresponding to the set broadcast relevant reference time [S1160]. In this case, the broadcast relevant information is received periodically or at a random timing point and is then stored in the memory unit 160.

The mobile terminal 100 can update the previously stored broadcast relevant information with reference to the newly received broadcast relevant information when the previously stored broadcast relevant information differs from newly received broadcast relevant information, if a valid period of the previously stored broadcast relevant information expires, or a request for an update of the broadcast relevant information is made by a user. The mobile terminal 100 can search program detail information on the first broadcast program and schedule information including broadcast programs of the first broadcast channel or another broadcast channel broadcast after the broadcast relevant reference time when specific broadcast relevant information corresponds to the broadcast relevant reference time. Moreover, the program detail information on the first broadcast program can contain interactive service information linked to the first broadcast program.

For clarity and convenience, the following description provides an example of setting a broadcast relevant reference time using a broadcast start time in the broadcast time information. FIGS. 12A to 12B, 13A to 13C and 14A to 14F are diagrams of screen configurations related to a process for setting a broadcast relevant reference time according to an embodiment of the present invention Referring to FIG. 12A, while a first broadcast program is being output, the mobile terminal 100 can receive an input of a search command signal for searching broadcast relevant information when a user selects a menu item 1211 of a broadcast relevant information search. In this case, the search command signal for the broadcast relevant information can be input if a key or a key region designated to a search command for broadcast relevant information and a corresponding menu item are both selected. As the search command signal for the broadcast relevant information is received, the mobile terminal 100 determines whether or not reference time data is received.

Figure 12A:
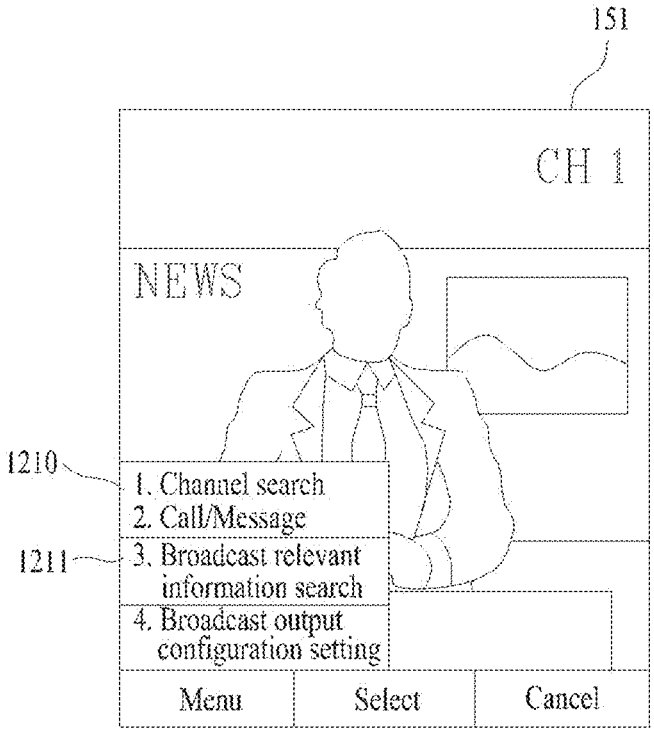
FIGS. 12A to 12B, 13A to 13C and 14A to 14F are diagrams of screen configurations related to a process for setting a broadcast relevant reference time according to an embodiment of the present invention.
Figure 12B:
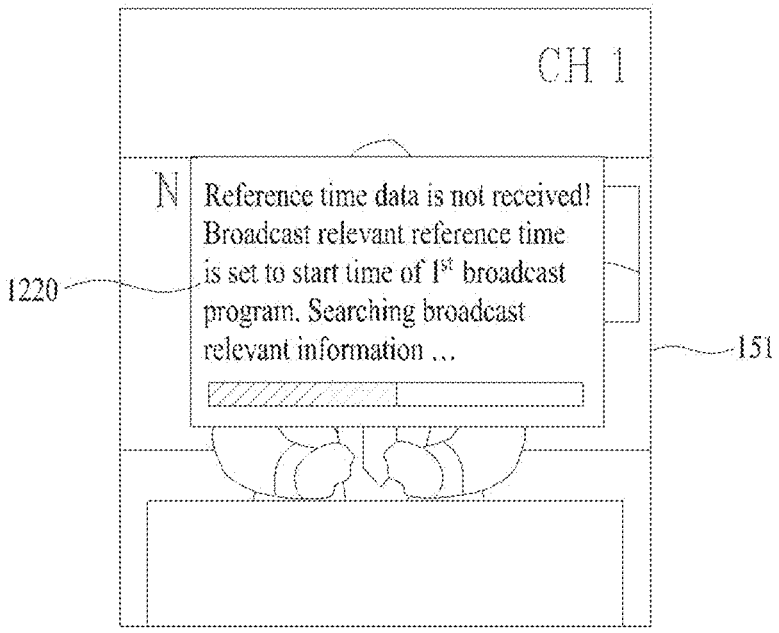

Referring to FIG. 12B, the mobile terminal 100 sets the broadcast relevant reference time to the broadcast start time of the first broadcast program and searches specific broadcast relevant information corresponding to the set broadcast relevant reference time when the reference time data is not received. As such, the mobile terminal 100 can output announcement information 1220 announcing that the broadcast relevant reference time is set to the broadcast start time of the first broadcast program. For example, the announcement information 1220 can be output using at least a speech signal, a bell sound, a vibration, a lamp, or text.

Figure 13A:
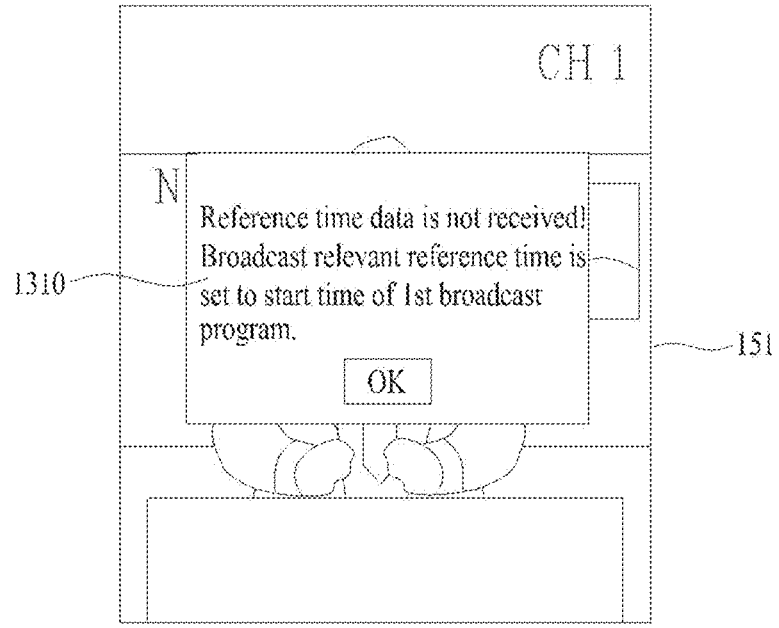

Referring to FIG. 13A, the mobile terminal 100 periodically checks whether or not reference time data is received when outputting a first broadcast program. If the mobile terminal 100 determines that the reference time data is not received, the mobile terminal 100 can set a broadcast relevant reference time to a broadcast start time of the first broadcast program. In this case, the mobile terminal 100 can announce via a popup window 1310 that the broadcast relevant reference time is set to the broadcast start time of the first broadcast program due to the non-reception of the reference time data.

Figure 13B:
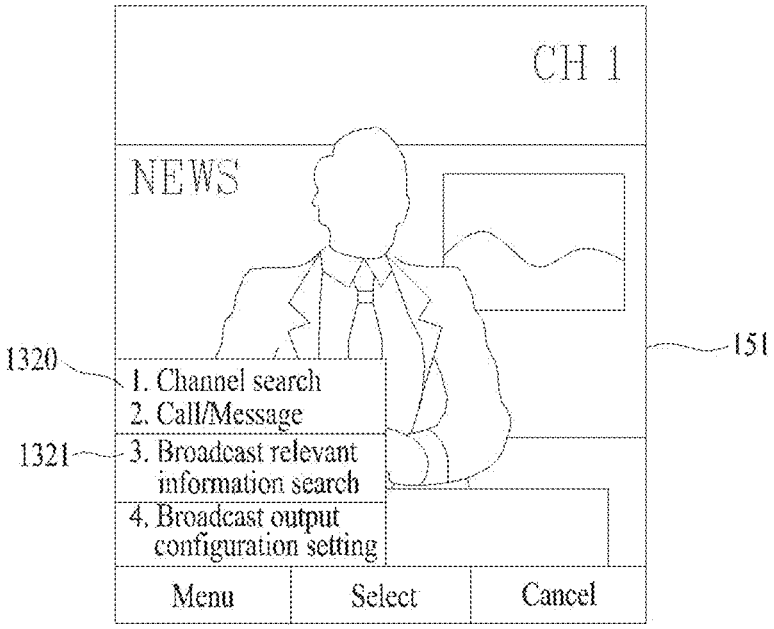
Figure 13C:
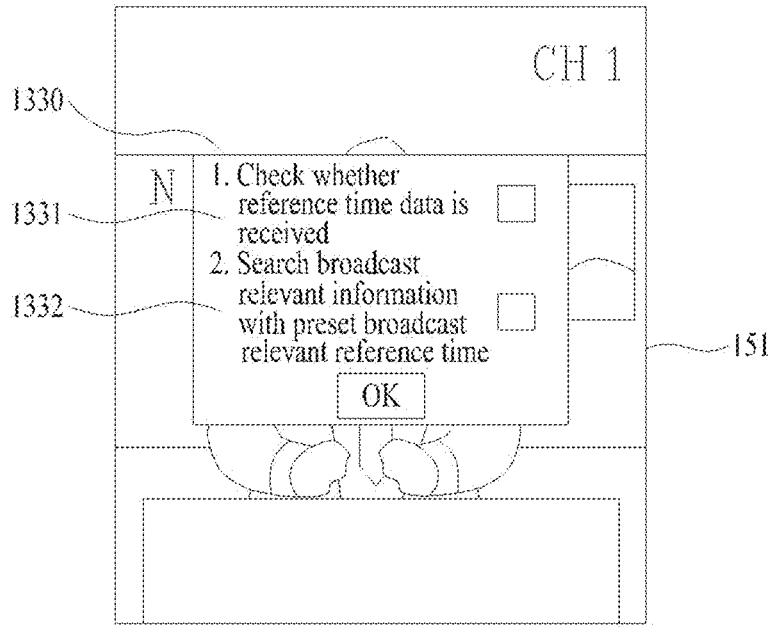

Referring to FIG. 13B, while the first broadcast program is being output, a menu item 1321 for a broadcast relevant information search can be displayed on the display module 151. Referring to FIG. 13C, the mobile terminal 100 can display a popup window 1330 for enabling the user to select either a check function 1331 to check the presence or non-presence of received reference time data or a search function 1332 to search for broadcast relevant information using preset broadcast relevant reference time.

Figure 14A:
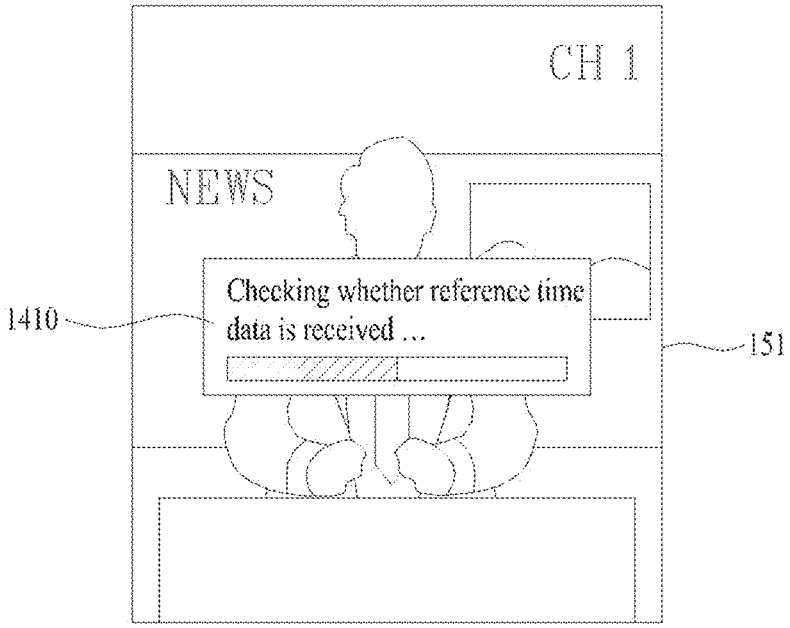
Figure 14B:
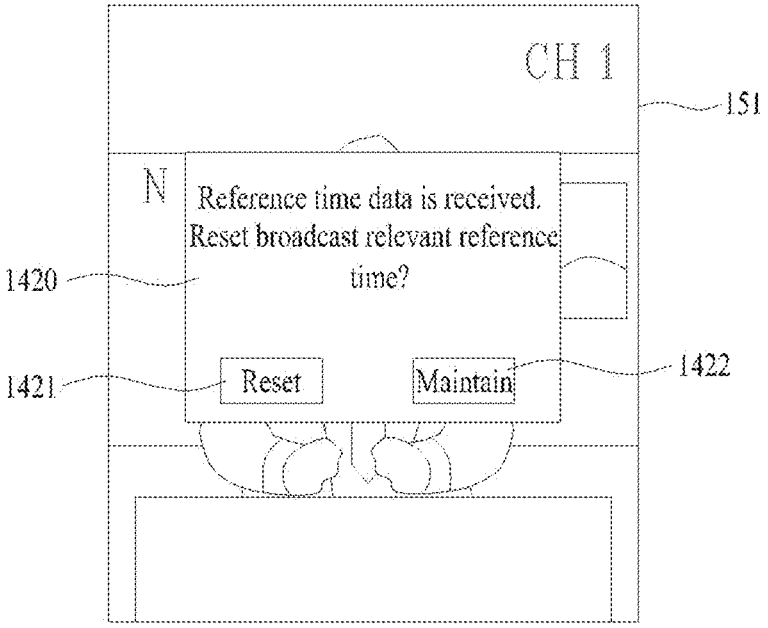
Figure 14C:
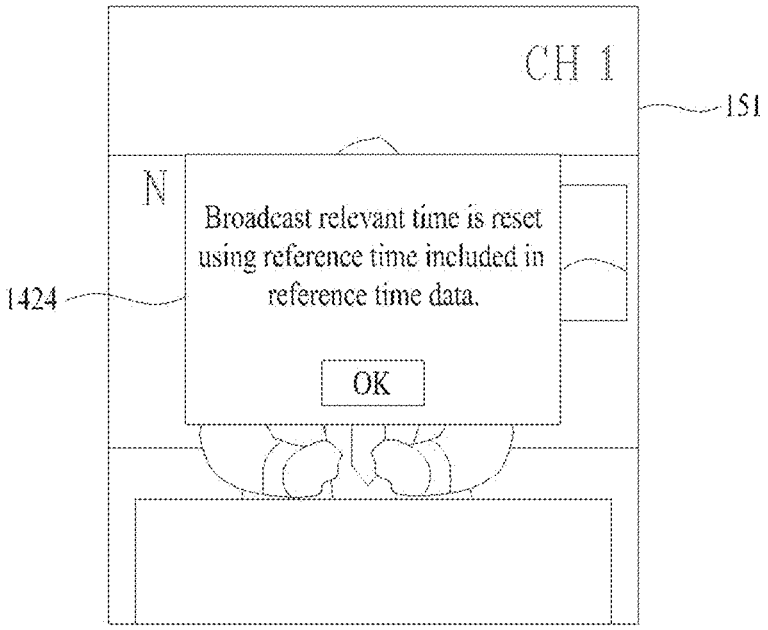

Referring to FIG. 14A, if the check function 1331 in FIG. 13B for checking received reference time data is selected, then the mobile terminal 100 can provide a visual display 1410 of its progress in querying the check. Referring to FIG. 14B, if the check function 1331 determines that the reference time data has been received, the mobile terminal 100 can display a popup window 1420 for enabling the user to select whether to reset the broadcast relevant reference time using the reference time information contained in the received reference time data by selecting "reset" 1421. Alternatively, the mobile terminal 100 can automatically reset the broadcast relevant reference time using the reference time information contained in the received reference time data. FIG. 14C depicts a popup window 1424 displayed on display module 151 for providing a status of the reset operation on the broadcast relevant reference time.

Figure 14D:
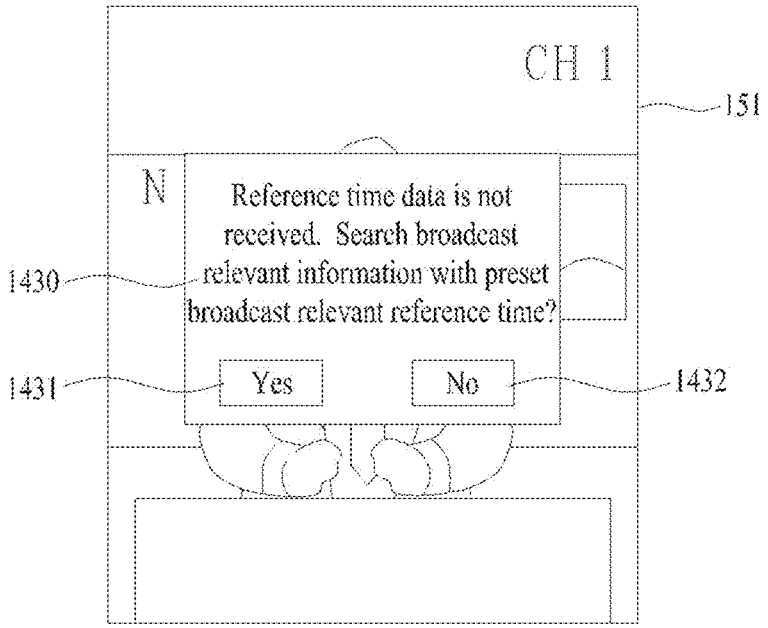

On the contrary, if the check function 1331 in FIG. 13B determines that the reference time data has not been received, then the mobile terminal 100 can display a popup window 1430 illustrated in FIG. 14D for enabling the user to select whether to search the broadcast relevant information with the preset broadcast relevant reference time. For example, if the user selects "yes" 1431 in the popup window 1430, the mobile terminal can search the broadcast relevant information corresponding to the preset broadcast relevant reference time.

Figure 14E:
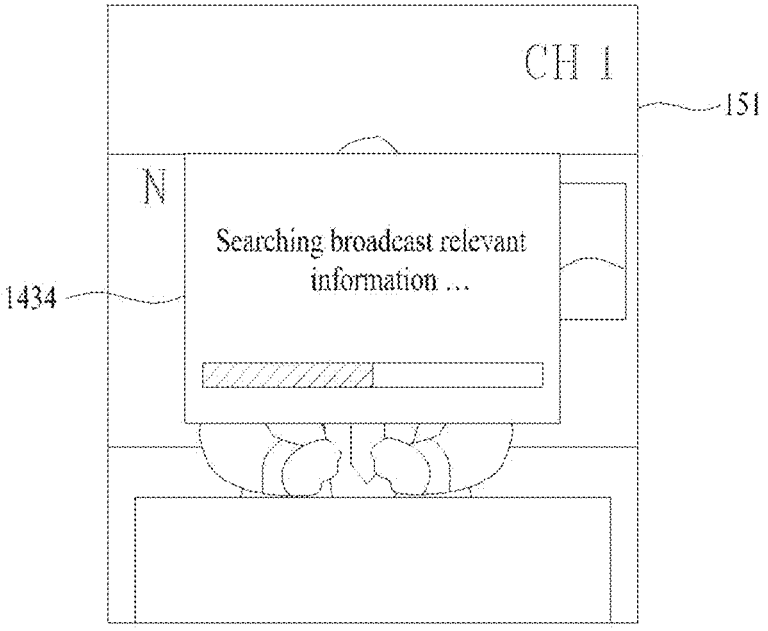
Figure 14F:
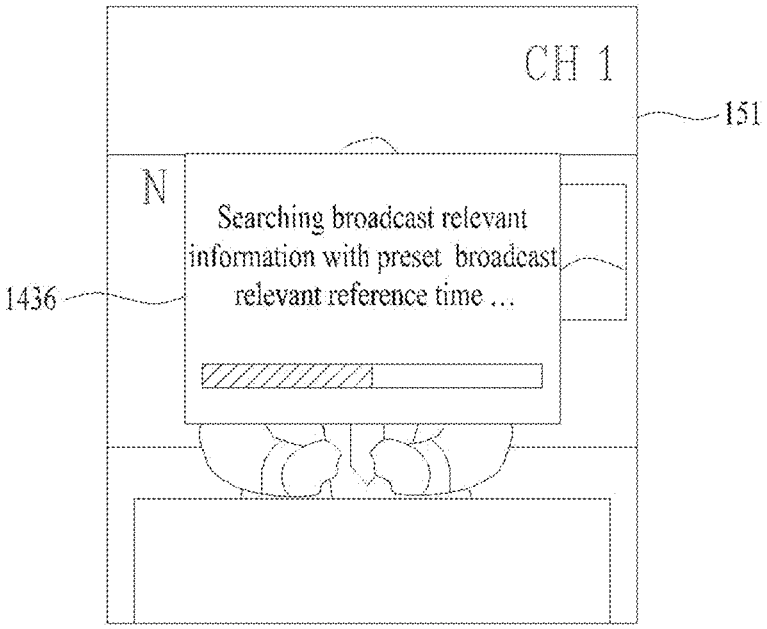

Referring to FIG. 14E, if the search for broadcast relevant information is selected, then the mobile terminal 100 can provide a visual display 1434 of its progress in querying an initial search of the broadcast relevant information. Subsequently, the mobile terminal 100 can provide a visual display 1436 via the display module 151 for providing a progress of a subsequent search of the broadcast relevant information with the preset broadcast relevant reference time as illustrated in FIG. 14F.

If the search function 1332 in FIG. 13C is selected, the mobile terminal 100 can search the broadcast relevant information corresponding to the set broadcast relevant reference time as illustrated in FIG. 13C.

Referring back to FIG. 11, under the control of the controller unit 180, the mobile terminal 100 outputs the searched specific broadcast relevant information via the output unit 150 [S1170]. Detailed broadcast information of the currently output first broadcast program and schedule information of the broadcast channel providing the first program or another broadcast channel can be output as the specific broadcast relevant information.

Figure 15A:
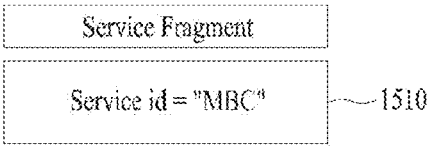
FIGS. 15A to 15C are diagrams of a data structure of broadcast relevant information corresponding to a broadcast relevant reference time according to an embodiment of the present invention.
Figure 15B:
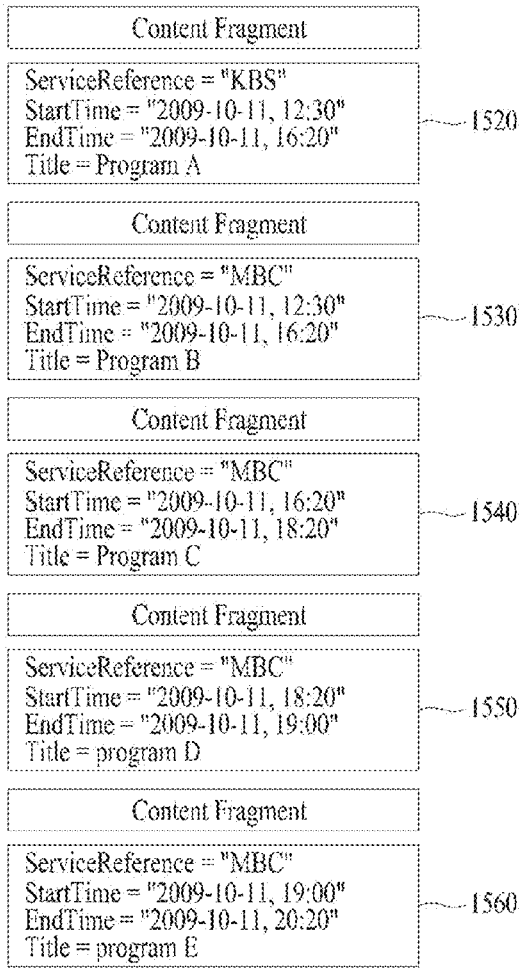
Figure 15C:
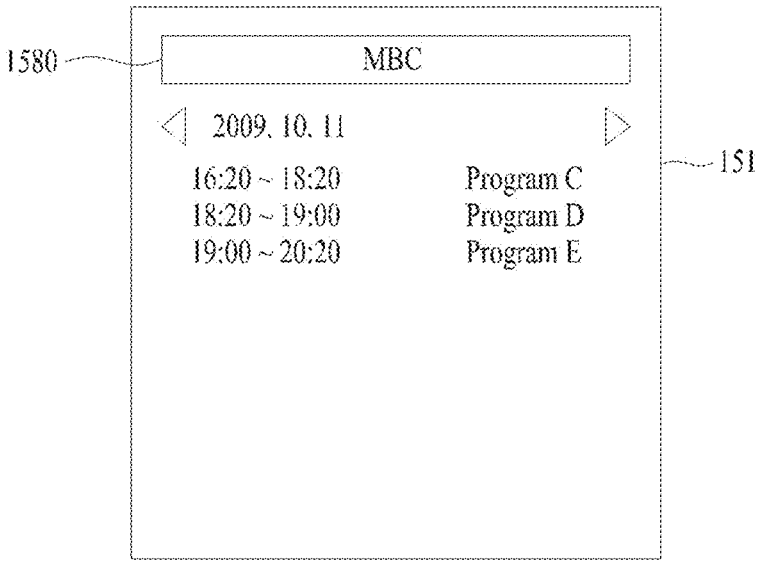

Outputting specific broadcast relevant information (S1170) is explained in detail with reference to the accompanying drawings. FIGS. 15A to 15C are diagrams of a data structure of broadcast relevant information corresponding to a broadcast relevant reference time according to an embodiment of the present invention.

For clarity and convenience of the following description, it can be assumed that the mobile terminal 100 is receiving or outputting a program C that is provided from a broadcast channel "MBC." It can also be assumed that a broadcast relevant reference time is set to "17:00 hours" corresponding to a broadcast start time of the program C.

Referring to FIG. 15A, broadcast relevant information can include an SGDU 1510 (e.g., service SGDU) having a service fragment set therein and a plurality of SGDUs 1520 to 1560 (e.g., content SGDU) having content fragments set therein. In this case, the service SGDU contains matching information (e.g., a service ID) with the content fragment. Additionally, the content SGDU can contain service identification information (e.g., ServiceReference), a broadcast start/end time of a corresponding program and a title of the corresponding program.

The mobile terminal 100 checks a service SGDU containing a service ID of a currently used broadcast channel 'MBC' and is then able to search content SGDUs 1540 to 1560 meeting the service ID "MBC" and a broadcast relevant reference time "17:00 hours" contained in the checked service SGDU. For example, the mobile terminal 100 can search the content SGDUs 1540 to 1560. In this case, identification information (e.g. ServiceReference) of each of the content SGDUs 1540 and 1560 is 'MBC.' Additionally, a broadcast relevant reference time each of the content SGDUs 1540 and 1560 exists between a broadcast start time and a broadcast end time contained in the corresponding content SGDU.

Referring to FIG. 15B, the mobile terminal 100 can display a schedule list including the broadcast start time, broadcast end time and program title contained in each of the extracted content SGDUs 1540 to 1560. Alternatively, the mobile terminal 100 can display a schedule list corresponding to another broadcast channel instead of the currently used broadcast channel (not shown). For example, the mobile terminal 100 extracts the content SGDU having a broadcast relevant reference time existing between the broadcast start time and the broadcast end time from all of the previously stored content SGDUs and is then able to display a schedule list including the broadcast start time, broadcast end time and program title of each of the extracted contents SGDUs for each broadcast channel.

FIGS. 16A to 16D are diagrams of screen configurations for outputting broadcast relevant information corresponding to a broadcast relevant reference time according to an embodiment of the present invention. For clarity and convenience of the following description, it can be assumed that the mobile terminal 100 can output a first broadcast program of a first broadcast channel. It can also be assumed that a broadcast relevant reference time is set to a broadcast start time of the first broadcast program.

Figure 16A:
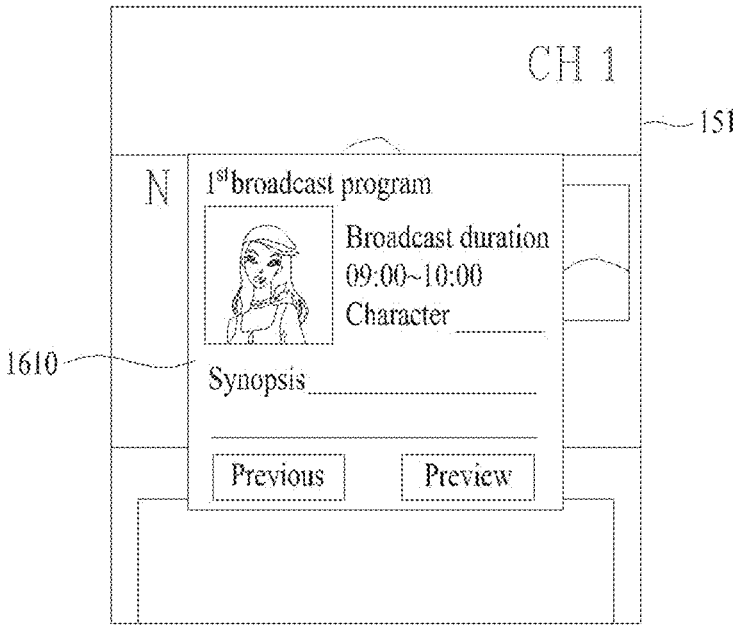
FIGS. 16A to 16D are diagrams of screen configurations for outputting broadcast relevant information corresponding to a broadcast relevant reference time according to an embodiment of the present invention.

Referring to FIG. 16A, the mobile terminal 100 can output detailed broadcast information 1610 (e.g., a broadcast duration, character information, a synopsis, a previous broadcast view, or a preview) of the currently output first broadcast program via the display module 151. For example, the detailed broadcast information of the first broadcast program can be contained in a content SGDU corresponding to the first broadcast program (e.g., ServiceReference=$1^{st}$ broadcast channel, Title=$1^{st}$ broadcast program).

Figure 16B:
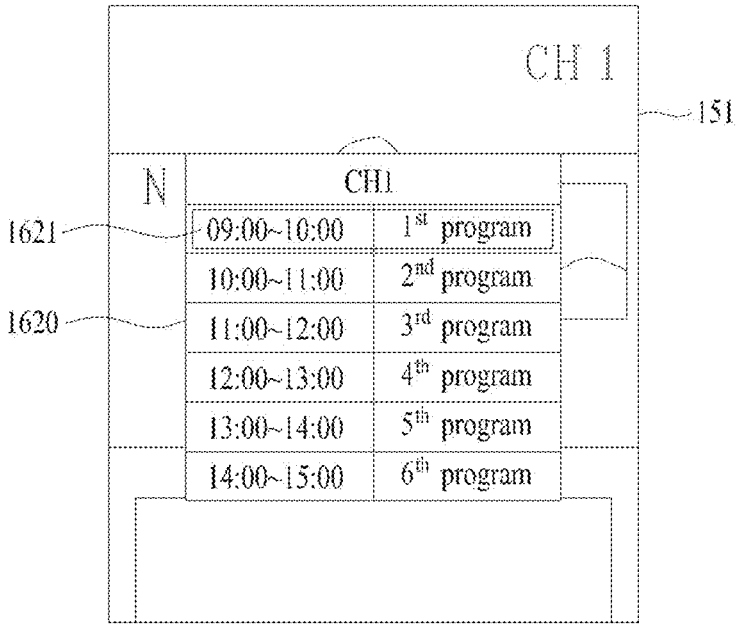
Figure 16C:
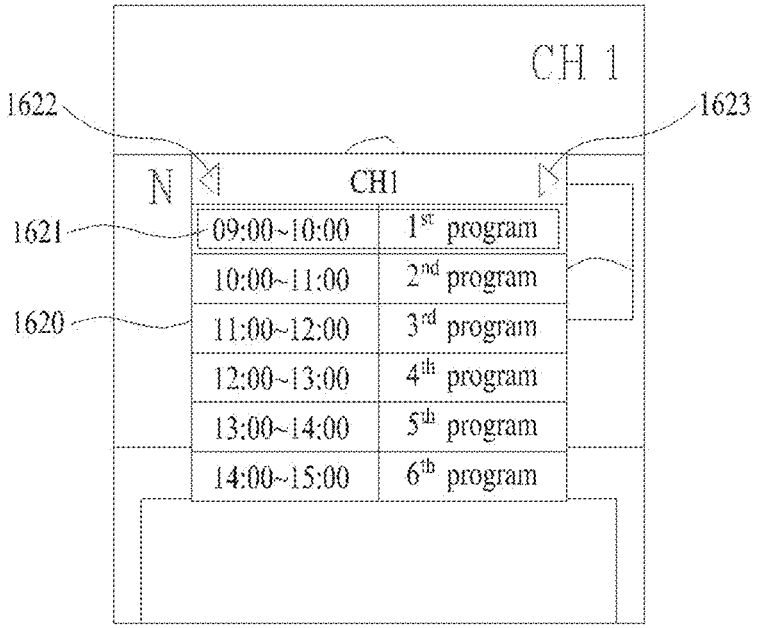

Referring to FIG. 16B, the mobile terminal 100 can display a schedule list 1620 of the first broadcast channel on which a currently output first broadcast program 1621 (e.g., "09:00~10:00 $1^{st}$ program") is provided, for example. In doing so, broadcast programs provided after the broadcast relevant reference time can be included in the schedule list 1620. A user can select a specific broadcast channel to be provided with a schedule list of the specific broadcast channel by manipulating direction keys 1622 and 1623 as illustrated in FIG. 16C.

Figure 16D:
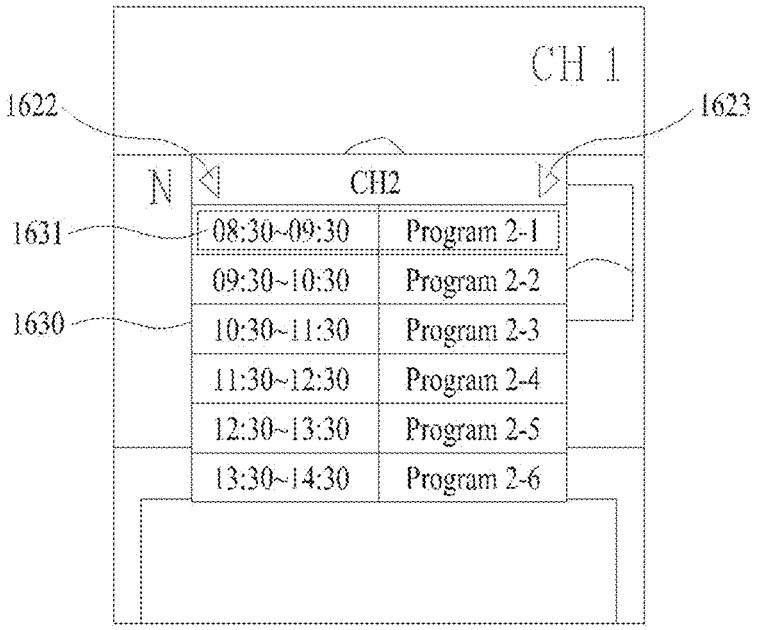

Referring to FIG. 16D, the mobile terminal 100 can display a schedule list 1630 of another broadcast channel as well as the currently used first broadcast channel, for example. In this case, broadcast programs provided on the corresponding broadcast channel after the broadcast relevant reference time can be included in the schedule list 1630.

FIGS. 17A to 17C are diagrams of a data structure related to interactive service information corresponding to a broadcast relevant reference time according to an embodiment of the present invention. For clarity and convenience of the following description, it can be assumed that the mobile terminal 100 receives and outputs a program "B" provided from the broadcast channel "MBC". It can also be assumed that a broadcast relevant reference time is set to a broadcast start time of the program "B" at "16:20 hours."

Referring to FIGS. 17A to 17C, broadcast relevant information or broadcast guide information can include the service SGDU 1510 as illustrated in FIG. 15A having a service fragment set therein, a plurality of interactivity SGDUs 1710 to 1730 having interactivity fragments set therein, an SGDU 1740 as illustrated in FIG. 17B having a schedule fragment set therein, and an SGDU 1750 as illustrated in FIG. 17C in which an access fragment containing channel information for receiving specific interactive service information set therein. The mobile terminal 100 checks a service SGDU including a service ID of a currently used broadcast channel 'MBC' and is then able to search the interactivity SGDU 1720 that meets the service ID 'MBC' contained in the checked service SGDU and a broadcast relevant reference time set at "16:20 hours." For example, the mobile terminal 100 can search a plurality of the interactivity SGDUs 1710 to 1730 for the interactivity SGDU 1720 of which broadcast relevant reference time set at "16:20 hours" belongs between an interactivity service start time (e.g., StartTime) and an interactivity service end time (e.g., EndTime) included as an interactivity window value (e.g., InteractivityWindow).

Referring to FIG. 17B, the mobile terminal 100 can search the schedule SGDU 1740 in which an ID value (e.g., idRef) of an interactivity data reference (e.g., InteractivityDataReference) is set to the same value of 'MBC_INT__2' corresponding to a schedule reference value (e.g., ScheduleReference) contained in the searched interactivity SGDU 1720 in FIG. 17A.

Referring to FIG. 17C, the mobile terminal 100 searches the access fragment 1750 matching a schedule ID "MBC_INT_SCH" of the schedule SGDU 1740 (FIG. 17B) and a service reference "MBC" (e.g., ServiceReference), opens a corresponding channel using channel connection information contained in the searched access fragment 1750, and is then able to receive interactivity service information corresponding to the interactivity SGDU 1720. For example, the interactivity service information can be received as an interactivity media document (IMD) file. When receiving a specific IMD file, if a group ID (e.g., GroupID) of the specific IMD file is identical to an IMD pointer of the interactivity SGDU 1720 (e.g., interactivity media document pointer), the mobile terminal 100 can determine that the specific IMD file contains the interactivity service information corresponding to the interactivity SGDU 1720.

Figure 18A:
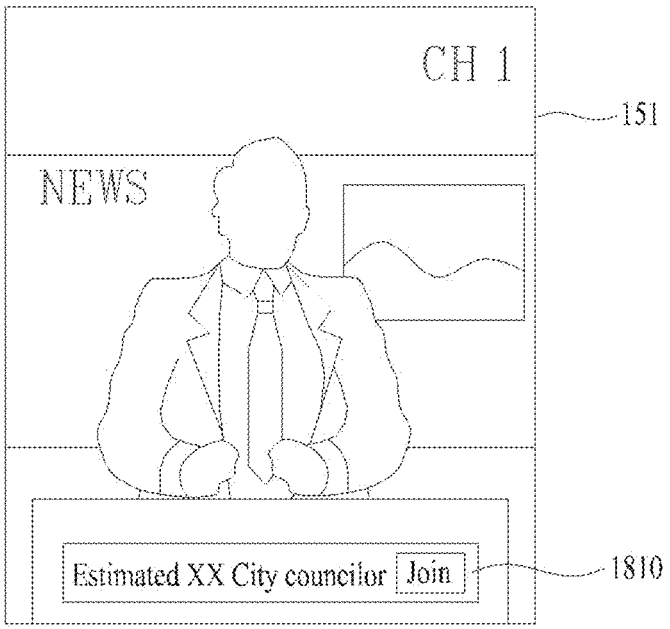
FIGS. 18A and 18B are diagrams of screen configurations for outputting interactive service information corresponding to a broadcast relevant reference time according to an embodiment of the present invention.
Figure 18B:
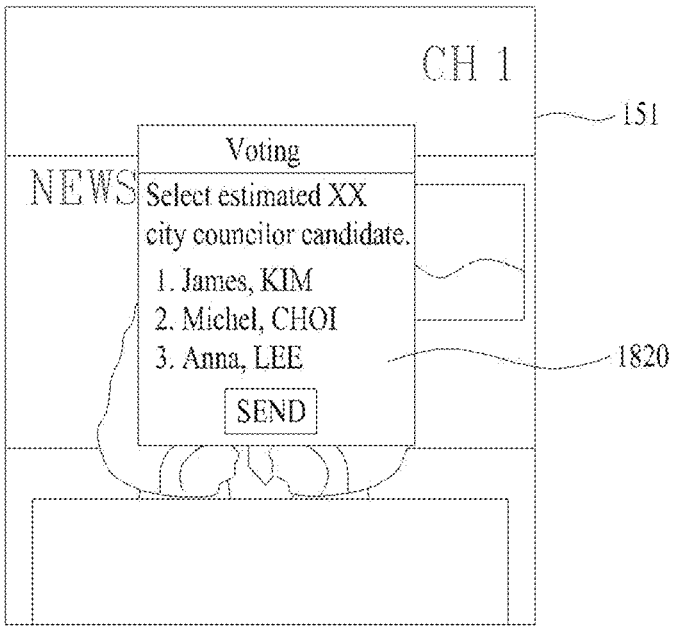

FIGS. 18A and 18B are diagrams of screen configurations for outputting interactive service information corresponding to a broadcast relevant reference time according to an embodiment of the present invention. Referring to FIGS. 18A and 18B, the mobile terminal 100 searches interactive service information corresponding to a currently output broadcast program and is then able to display the searched interactive service information via the display module 151. In doing so, the mobile terminal 100 sets a broadcast relevant current time to a broadcast start time of the currently output broadcast program and is then able to search interactive service information corresponding to the set broadcast relevant current time.

Meanwhile, under the control of the controller unit 180, the mobile terminal 100 can determine if data including reference time information is received periodically or at a random timing point despite that the broadcast relevant reference time has been set using the first broadcast time information. When determining that the reference time data has been received, the controller unit 180 releases the previously set broadcast relevant reference time and then resets a broadcast relevant reference time using the reference time information contained in the received reference time data. When determining that the reference time data has not been received, the controller unit 180 can maintain the previously ser broadcast relevant reference time.

Figure 19:
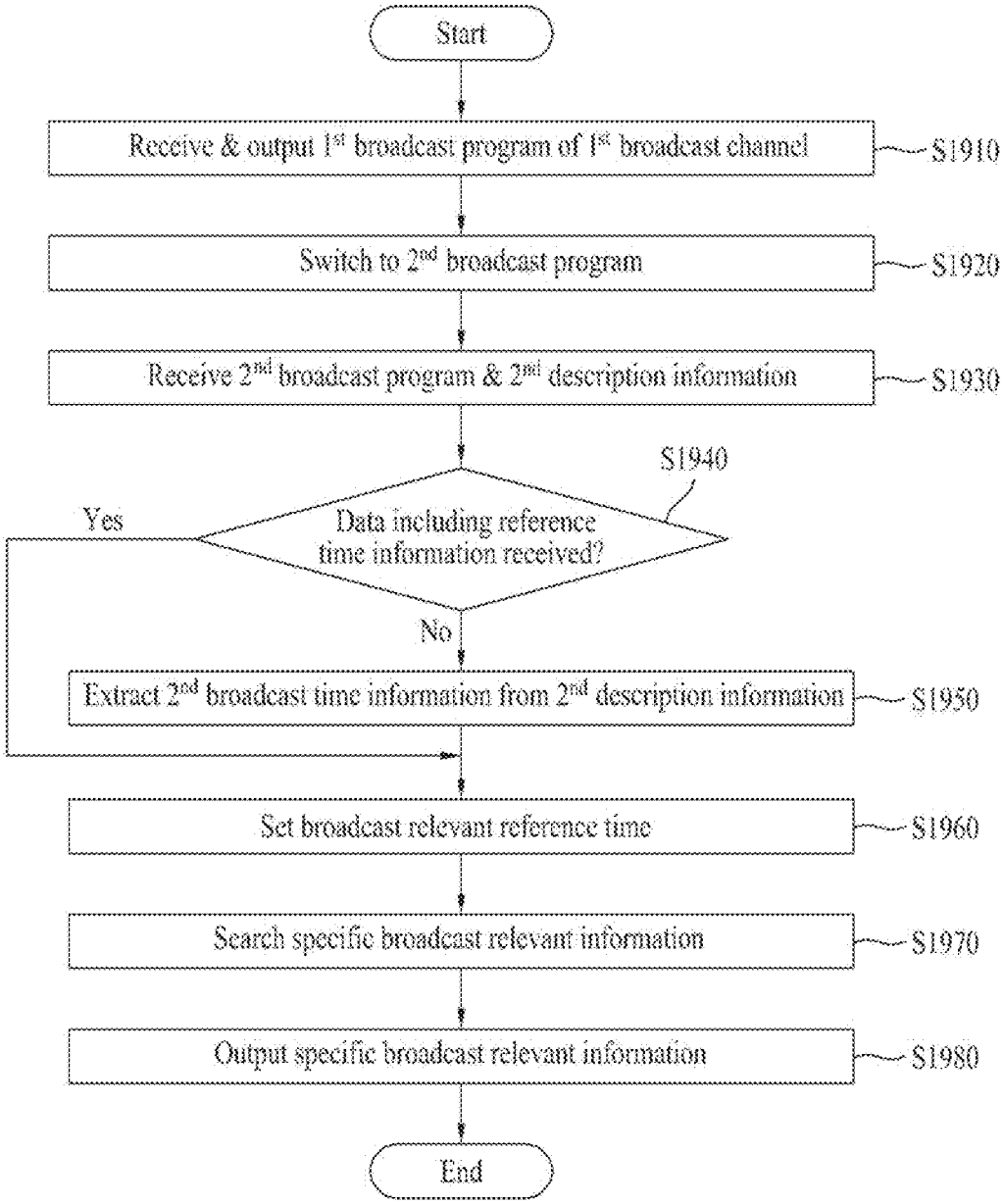
FIG. 19 is a flowchart of a broadcast controlling method of a mobile terminal according to another embodiment of the present invention.

In the following description, a process for searching and outputting specific broadcast relevant information using a broadcast relevant reference time when switching to a specific broadcast program is explained with reference to FIG. 19. FIG. 19 is a flowchart illustrating a broadcast controlling method of the mobile terminal 100 according to an embodiment of the present invention.

Referring to FIG. 19, the mobile terminal 100 receives and outputs a first broadcast program of a first broadcast channel [S1910]. Moreover, the mobile terminal 100 can receive first description information related to the first broadcast program.

The mobile terminal 100 switches reception and output of a target broadcast program from the first broadcast program to the second broadcast program under the control of the controller unit 180 when the reception and output of the first broadcast program is complete or the second broadcast program is selected before the completion thereof [S1920]. Subsequently, the mobile terminal 100 receives second description information related to the switched first and second broadcast programs via the wireless communication unit 110 [S1930].

For example, when determining that the broadcast time information or program title contained in each of the previously received description information and the currently received description information is changed, the mobile terminal 100 can detect the switching of the broadcast program. In particular, the broadcast time information or program title contained in each of the first and second description information can be distinguished. When receiving an input of a broadcast program switch command from a user, the mobile terminal 100 can switch the broadcast program.

Subsequently, the mobile terminal 100 can output the received second broadcast program via the output unit 150 under the control of the controller unit 180. After receiving and outputting the second broadcast program, under the control of the controller unit 180, the mobile terminal 100 determines whether or not reference time data has been received [S1940]. The aforesaid description of the reference time data is referred to herein.

When determining that the reference time data has not been received, the mobile terminal 100 extracts second broadcast time information from the received second description information under the control of the controller unit 180 [S1950]. For example, the extracted second broadcast time information includes a broadcast start time 1001 and a broadcast end time of the second broadcast program or a broadcast duration 1002 of the second broadcast program (FIG. 10).

Afterwards, under the control of the controller unit 180, the mobile terminal 100 sets a broadcast relevant reference time using the extracted second broadcast time information [S1960]. If a previously set broadcast relevant reference time exists prior to switching from the first broadcast program to the second broadcast program, the controller unit 180 releases the previously set broadcast relevant reference time and is then able to reset the broadcast relevant reference time using the extracted second broadcast time information.

For example, the previously set broadcast relevant reference time is set using the broadcast time information of the first broadcast program (i.e., the program is output before switching to the second broadcast program) or a current time contained in the reference time data received before switching to the second broadcast program. In another example, the mobile terminal 100 can set the broadcast relevant reference time to at least a broadcast start time of the second broadcast program, a random time between a broadcast start and end time of the first broadcast program, a broadcast end time of the first broadcast program, or a random time between the broadcast start time of the first broadcast program and expiration of a broadcast duration of the first broadcast program.

Accordingly, the mobile terminal 100 sets the broadcast relevant reference time to a time selected from a plurality of times settable as the broadcast relevant reference time by a user. Alternatively, the mobile terminal 100 can automatically set the broadcast relevant reference time to a time randomly selected by the controller unit 180.

Further, the mobile terminal 100 searches the broadcast relevant information previously stored in the memory unit 160 for specific broadcast relevant information corresponding to the set broadcast relevant reference time under the control of the controller unit 180 [S1970]. The mobile terminal 100 outputs the searched specific broadcast relevant information via the output unit 150 under the control of the controller unit 180 [S1980].

Detailed broadcast information of the currently output second broadcast program and schedule information with reference to the broadcast relevant reference time of a broadcast channel providing the second broadcast program or another broadcast channel can be output as the specific broadcast relevant information.

For clarity and convenience, the following description provides an example of setting a broadcast relevant reference time using a broadcast start time in broadcast time information. It can be assumed that the mobile terminal 100 is outputting a second broadcast program of a first broadcast channel. It can also be assumed that a broadcast relevant reference time is set to a broadcast start time of the second broadcast program.

In the following description, a process for resetting a broadcast relevant reference time when switching broadcast programs is explained in detail with reference to FIGS. 20A to 20E. FIGS. 20A to 20E are diagrams of screen configurations for a process of resetting a broadcast relevant reference time when switching a broadcast program according to an embodiment of the present invention.

Figure 20A:
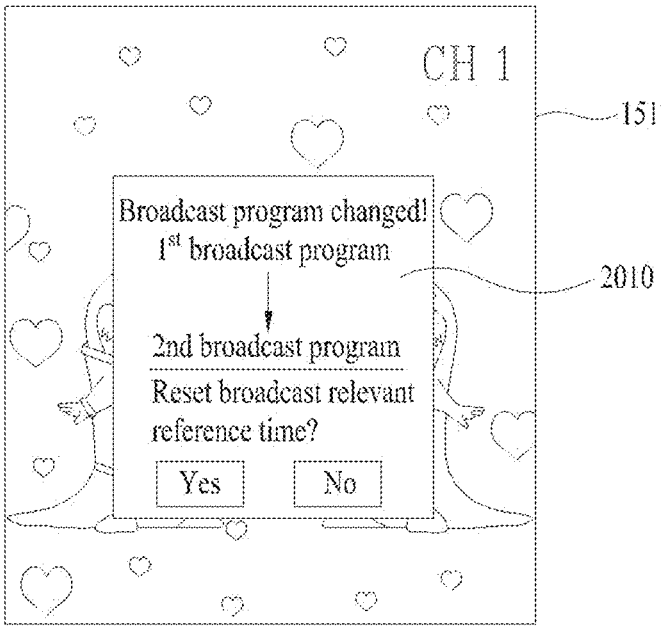
FIGS. 20A to 20E are diagrams of screen configurations for a process for resetting a broadcast relevant reference time when switching a broadcast program according to an embodiment of the present invention.

Referring to FIG. 20A, when a reception and output target broadcast program is switched from a first broadcast program to a second broadcast program, the mobile terminal 100 can display a popup window 2010 via the display module 151. The popup window 2010 indicates a broadcast program change and enabling a user to select whether to reset a broadcast relevant reference time.

Figure 20B:
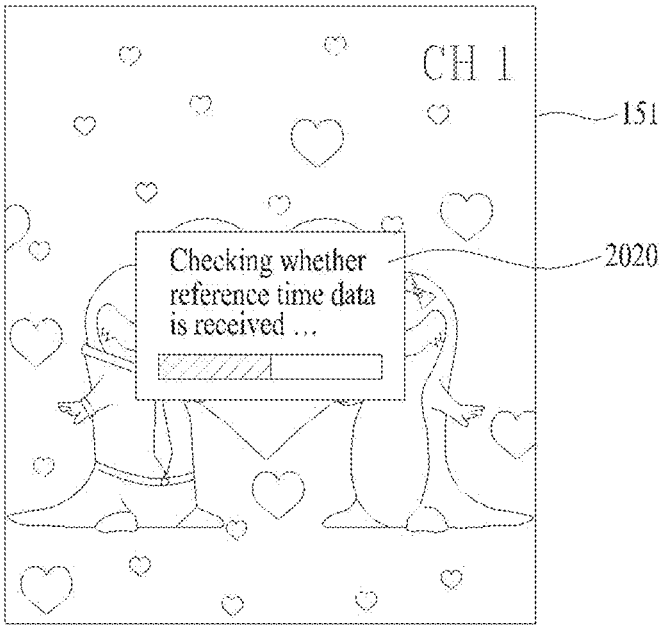

Referring to FIG. 20B, if "yes" for resetting is selected in FIG. 20A, the mobile terminal 100 can determine whether reference time data has been received. In particular, the mobile terminal 100 can determine whether the reference time data is received after the switch to the second broadcast program. Additionally, a status popup window 2020 can be displayed via the display module 151 to show a status of whether or not the reference time data has been received.

Figure 20C:
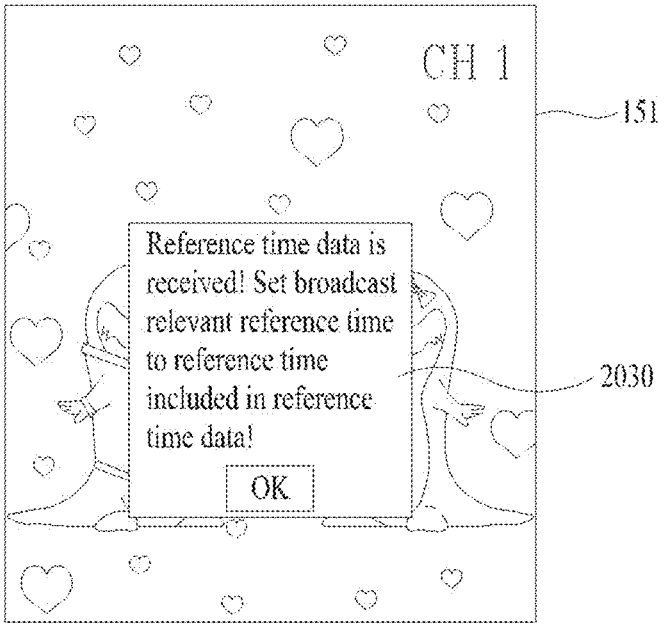
Figure 20D:
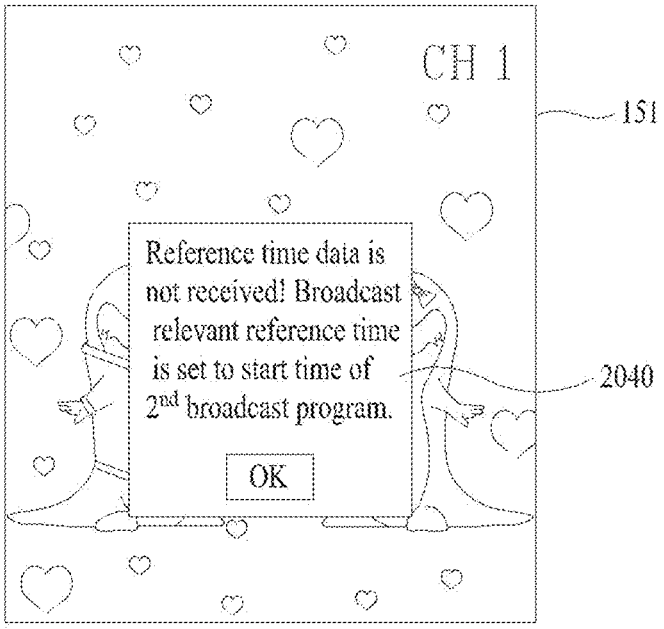

Referring to FIG. 20C, when it is determined that the reference time data has been received (FIG. 20B), the mobile terminal 100 sets the broadcast relevant reference time to a reference time or a current time contained in the reference time data and is then able to inform a user of the set broadcast relevant reference time. Referring to FIG. 20D, when it is determined that the reference time data has not been received (FIG. 20B), the mobile terminal 100 sets the broadcast relevant reference time to a broadcast start time of the second broadcast program and is then able to inform a user of the set broadcast relevant reference time.

Figure 20E:
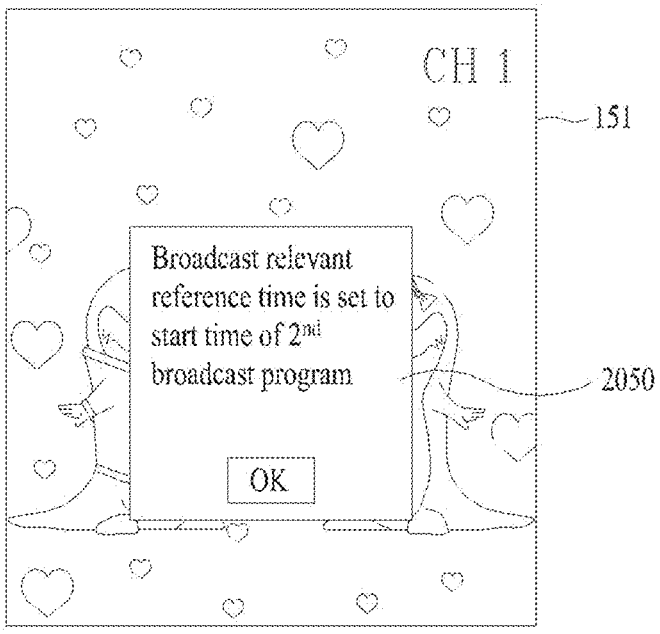

Referring to FIG. 20E, if a reception and output target broadcast program is switched from a first broadcast program to a second broadcast program, the mobile terminal 100 does not determine whether reference time data has been received. Instead, the mobile terminal 100 sets the broadcast relevant reference time to a broadcast start time of the second broadcast program and is then able to inform a user of the set broadcast relevant reference time.

Although a broadcast program is switched, the mobile terminal 100 can perform a broadcast relevant reference time resetting operation only if a search command signal input for broadcast relevant information is received from a user (not shown). Moreover, if reception of reference time data is detected, the mobile terminal 100 can reset a broadcast relevant reference time to a current time contained in the received reference time data even though the broadcast relevant reference time is set to a broadcast start time of a switched broadcast program (not shown).

Figure 21:
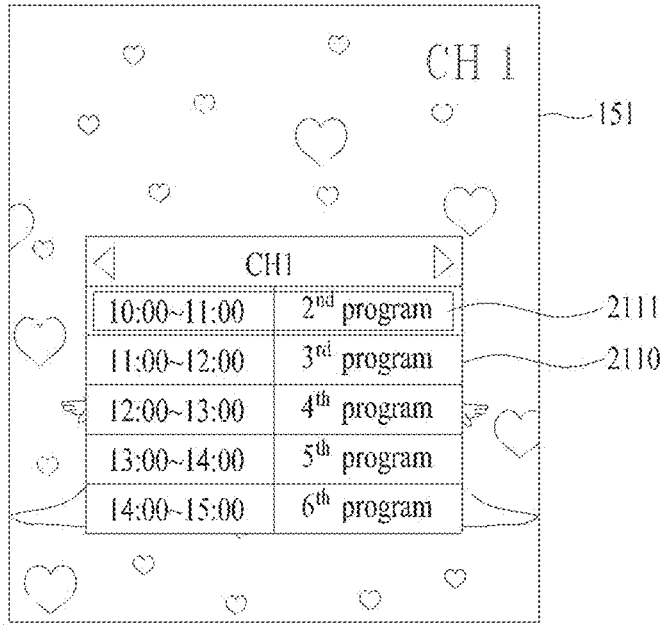
FIG. 21 is a diagram of screen configuration for outputting broadcast relevant information corresponding to a broadcast relevant reference time reset when switching a broadcast program according to an embodiment of the present invention.

FIG. 21 is a diagram of screen configuration for outputting broadcast relevant information corresponding to a broadcast relevant reference time reset when switching a broadcast program according to an embodiment of the present invention. Referring to FIG. 21, the mobile terminal 100 displays a schedule list 2110 of a first broadcast channel via the display module 151 on which a currently output second broadcast program is provided. In this case, broadcast programs (e.g., $2^{nd}$ program 2111) provided after a broadcast relevant reference time can be contained in the schedule list 2110.

Figure 22:
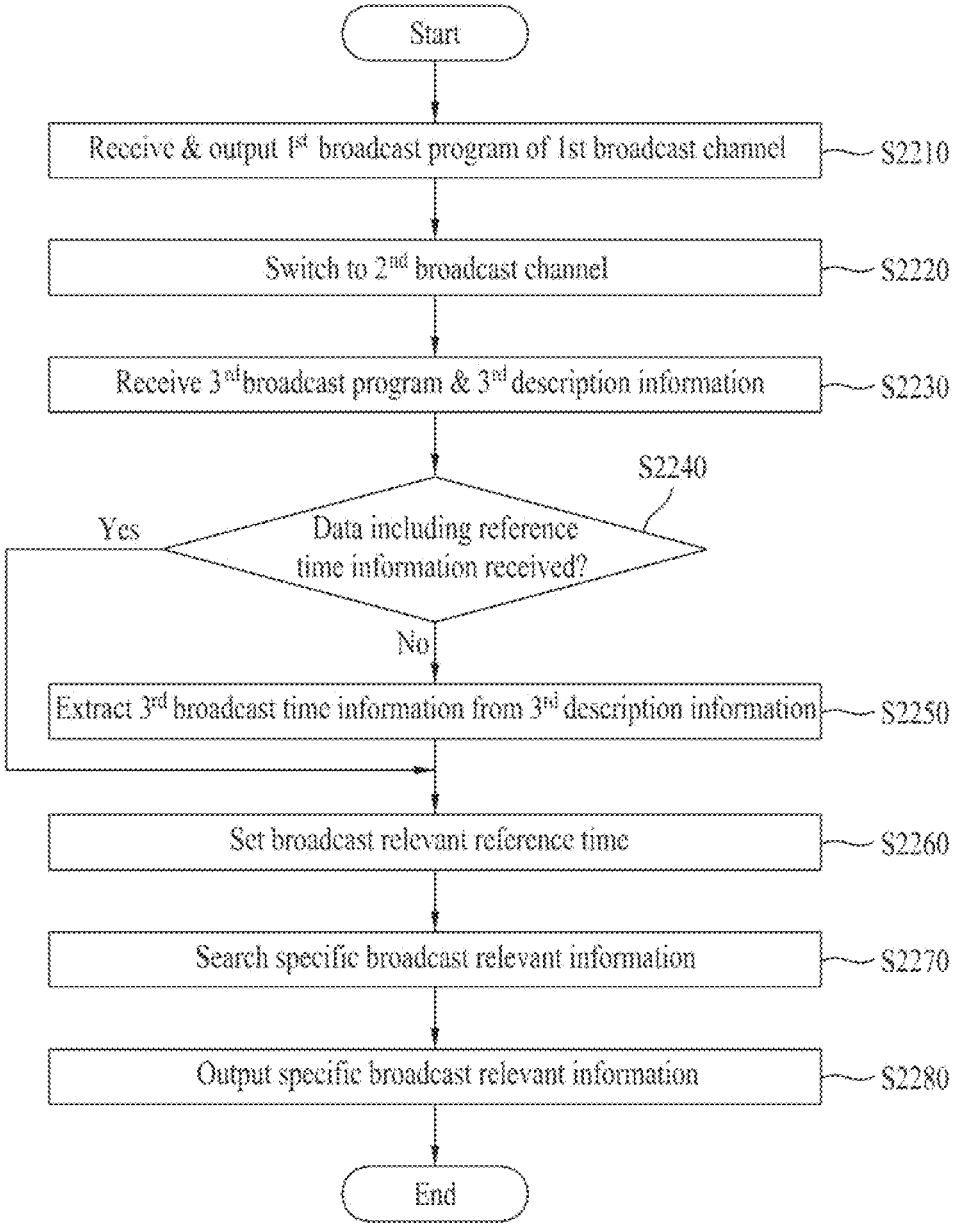
FIG. 22 is a flowchart of a broadcast controlling method of a mobile terminal according to another embodiment of the present invention.

In the following description, a process for searching and outputting specific broadcast relevant information using a broadcast relevant reference time when switching to a broadcast channel is explained with reference to FIG. 22. FIG. 22 is a flowchart of a broadcast controlling method of the mobile terminal 100 according to another embodiment of the present invention.

Referring to FIG. 22, the mobile terminal 100 receives and outputs a first broadcast program of a first broadcast channel [S2210]. The mobile terminal 100 can receive first description information related to the first broadcast program.

Subsequently, according to a broadcast channel switching command signal input from a user, the mobile terminal 100 switches from the currently used first broadcast channel to a second broadcast channel [S2220]. For example, it can be assumed that a third broadcast program is provided on the second broadcast channel at a timing point when switching to the second broadcast channel.

Afterwards, the mobile terminal 100 receives the third broadcast program provided on the second broadcast channel and third description information related to the third broadcast program [S2230]. Under the control of the controller unit 180, the mobile terminal 100 can output the received third broadcast program via the output unit 150.

For example, when it has been determined that broadcast time information or program title contained in each of the currently received description information and the previously received description information has been changed or an input of a broadcast channel switching command signal has been received from a user, the mobile terminal 100 can detect the switching of the broadcast channel. In particular, the broadcast time information or the program title contained in each of the first description information and the third description information can be distinguished.

Under the control of the controller unit 180, the mobile terminal 100 determines whether reference time data is received after receiving and outputting the third broadcast program [S2240]. When determining that the reference time data has not been received, the mobile terminal 100 extracts third broadcast time information from the received third description information under the control of the controller unit 180 [S2250].

For example, the extracted third broadcast time information includes a broadcast start time 1001 and end time of the third broadcast program or a broadcast duration 1002 of the third broadcast program from the third description information (FIG. 10). Afterwards, under the control of the controller unit 180, the mobile terminal 100 sets a broadcast relevant reference time using the extracted third broadcast time information [S2260].

When setting the broadcast relevant reference time, if a previously set broadcast relevant reference time exists prior to the switching from the first broadcast channel to the second broadcast channel, the controller unit 180 releases the previously set broadcast relevant reference time and is then able to reset the broadcast relevant reference time using the extracted third broadcast time information. For example, the previously set broadcast relevant reference time is set using the broadcast time information of the first broadcast program (i.e., the program output before switching to the second broadcast channel) or a current time contained in the reference time data received before the switching to the second broadcast channel.

The mobile terminal 100 searches the broadcast relevant information previously stored in the memory unit 160 for specific broadcast relevant information corresponding to the set broadcast relevant reference time under the control of the controller unit 180 [S2270]. The mobile terminal 100 can output the searched specific broadcast relevant information via the output unit 150 under the control of the controller unit 180 [S2280]. Detailed broadcast information of the currently output third broadcast program and schedule information with reference to the broadcast relevant reference time of a broadcast channel providing the third broadcast program or another broadcast channel can be output as the specific broadcast relevant information.

In the following description, a process for resetting a broadcast relevant reference time when switching broadcast channels is explained in detail with reference to FIG. 23A to 23C. For clarity and convenience, the following description is an example of setting a broadcast relevant reference time using a broadcast start time in broadcast time information.

Figure 23A:
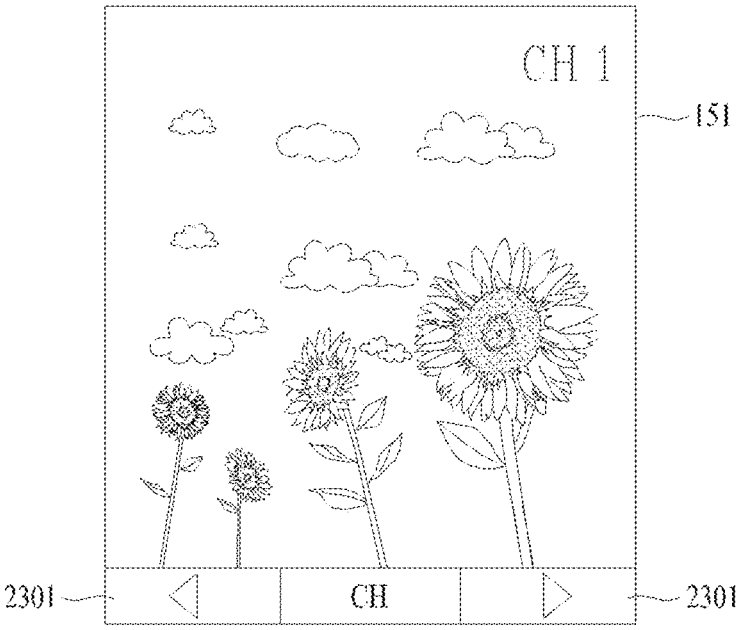
FIGS. 23A to 23C are diagrams of screen configurations for a process of resetting a broadcast relevant reference time when switching a broadcast channel according to an embodiment of the present invention.
Figure 23B:
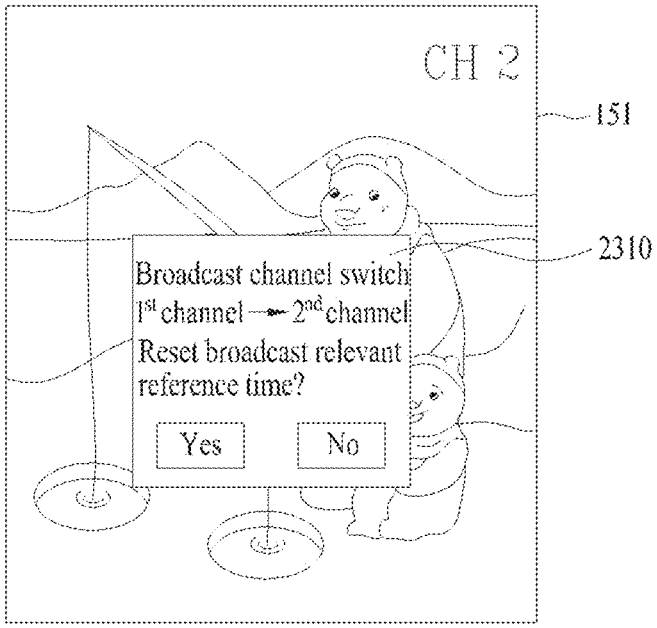
Figure 23C:
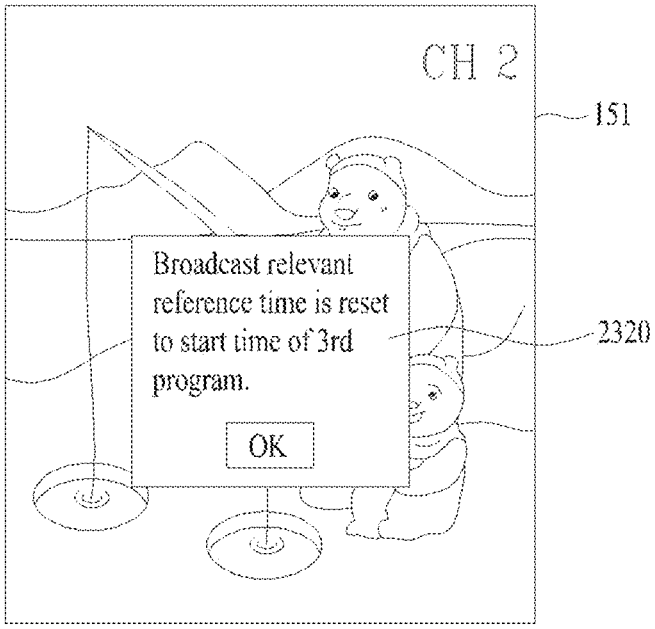

Referring to FIGS. 23A to 23B, when a first broadcast channel is switched to a second broadcast channel by manipulating a channel switching key 2301, the mobile terminal 100 can display a popup window 2310 for enabling a user to select whether or not to reset a broadcast relevant reference time.

Referring to FIG. 23B, if "yes" for resetting is selected in FIG. 23B, the mobile terminal 100 sets the broadcast relevant reference time to a broadcast start time of a third broadcast program currently provided on the second broadcast channel. The mobile terminal 100 provides a popup window 2320 via the display module 151 to inform a user of the broadcast relevant reference time set according to the broadcast start time of the third broadcast program as illustrated in FIG. 23C. Moreover, the mobile terminal 100 can determine whether reference time data is received after the switching to the second broadcast channel.

When determining that the reference time data has been received, the mobile terminal 100 sets the broadcast relevant reference time to a reference time or a current time contained in the received reference time data. Alternatively, the mobile terminal 100 sets the broadcast relevant reference time to a broadcast start time of the third broadcast program when it has been determined that the reference time data has not been received.

Although a broadcast channel can be switched, the mobile terminal 100 can perform a broadcast relevant reference time resetting operation only if a search command signal input for broadcast relevant information has been received from a user. Moreover, if a reception of reference time data is detected, the mobile terminal 100 can reset the broadcast relevant reference time to a current time contained in the received reference time data, even though a broadcast relevant reference time is set to a broadcast start time of a broadcast program currently provided on a switched broadcast channel.

Figure 24:
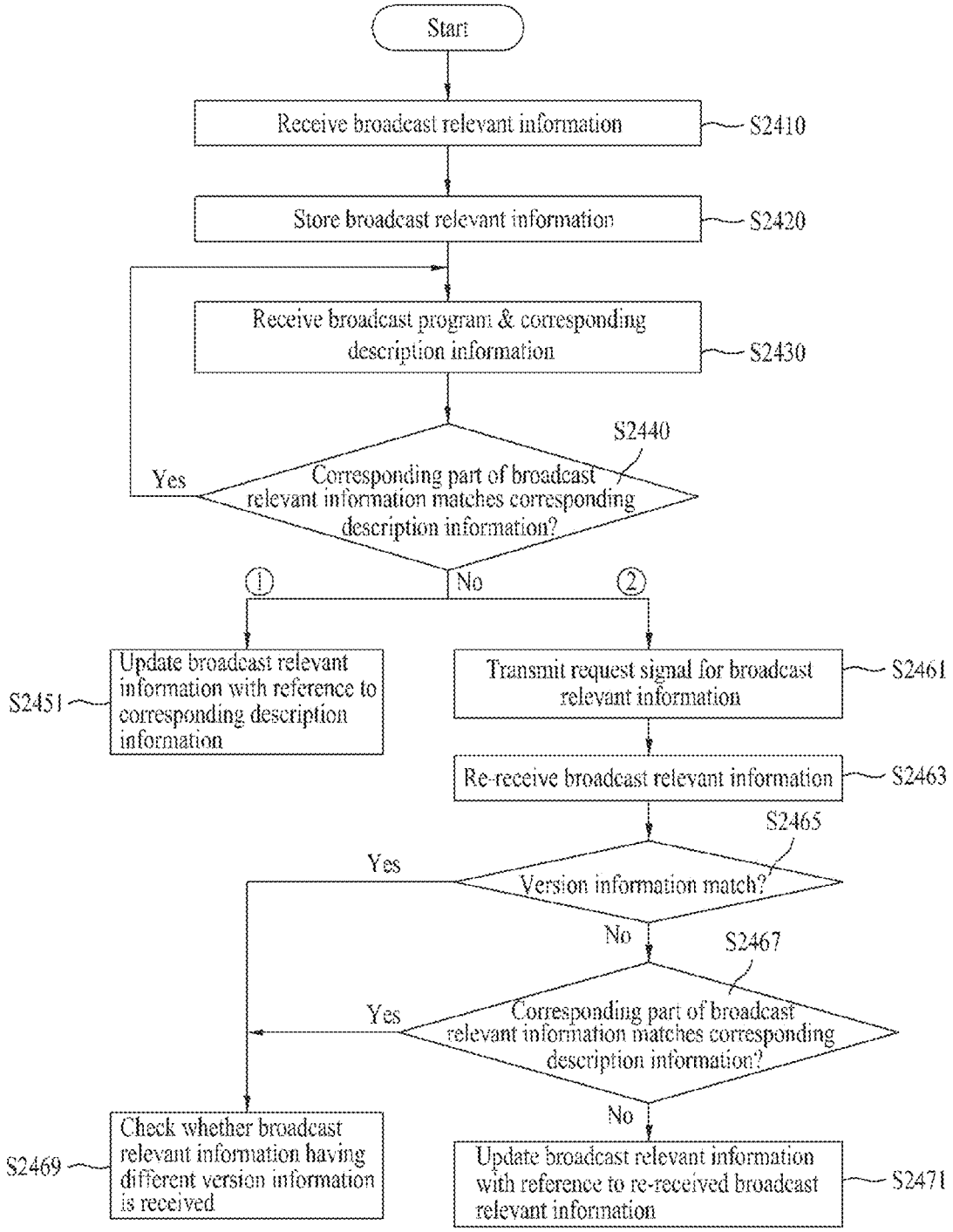
FIG. 24 is a flowchart of a broadcast controlling method of a mobile terminal according to another embodiment of the present invention.

In the following description, a process for updating previously stored broadcast relevant information with reference to description information is explained with reference to FIG. 24. FIG. 24 is a flowchart illustrating a broadcast controlling method of the mobile terminal 100 according to another embodiment of the present invention.

Referring to FIG. 24, the mobile terminal 100 receives broadcast relevant information via the wireless communication unit 110 [S2410]. The mobile terminal 100 then stores the received broadcast relevant information in the memory unit 160 under the control of the controller unit 180 [S2420].

In some embodiments, the mobile terminal 100 can receive broadcast relevant information from a broadcast relevant server periodically or at a random timing point. The mobile terminal 100 receives broadcast relevant information according to a periodicity or timing point determined by a user or can receive broadcast relevant information unilaterally transmitted from the broadcast relevant server.

When an input of a transmission command action of a request signal for broadcast relevant information is received from a user or new broadcast relevant information that needs to be received is determined, the mobile terminal 100 transmits a request signal for broadcast relevant information to the broadcast relevant server. The mobile terminal 100 is then able to receive the broadcast relevant information from the broadcast relevant server, even though a periodic reception or a timing point of broadcast relevant information has been previously set.

When previously stored broadcast relevant information exists and new broadcast relevant information is received, the mobile terminal 100 compares version information of the previously stored broadcast relevant information to version information of the newly received broadcast relevant information. If the version information is distinguishable from each other, the mobile terminal 100 can update the previously stored broadcast relevant information with reference to the newly received broadcast relevant information. For example, the mobile terminal 100 can receive the SGDD and is then able to determine whether version information of the received SGDD matches version information of previously stored SGDD when it is assumed that the broadcast relevant information contains the SGDD and SGDU.

If the mobile terminal 100 determines that the version information of the received SGDD is different from the version information of the previously stored SGDD, the mobile terminal 100 receives the SGDU using the received SGDD and is then able to update the previously stored SGDU with reference to the received SGDU. Meanwhile, if the mobile terminal 100 determines that the version information of the received SGDD matches the version information of the previously stored SGDD, the mobile terminal 100 may receive the SGDU using the received SGDD. If the version information of each SGDD matches each other, then contents of the SGDU received using the SGDD should match each other, for example.

The mobile terminal 100 receives a first broadcast program of a first broadcast channel and first description information related to the first broadcast program via the wireless communication unit 110 [S2430]. In particular, the broadcast program and its description information can be received using the broadcast receiving module 111. The mobile terminal 100 can receive the first broadcast program and the first description information on a frequency band allocated to the first broadcast channel.

For example, the first description information can contain at least a broadcast start time 1001, a broadcast end time, a broadcast duration 1002, or a program title 1003 of the first broadcast program (FIG. 10). Accordingly, if the received broadcast program changes, its description information should change as well. Further, the received first description information can be stored in the memory unit 160.

According to the ATSC-MH standard, the first broadcast channel can include one of at least one or more services contained in a specific ensemble (FIG. 5). Under the control of the controller unit 180, the mobile terminal 100 outputs the received first broadcast program via the output unit 150. For example, the first broadcast program can contain audio and video data such that the audio data can be output via the audio output module 152 and the video data can be output via the display module 151.

Under the control of the controller unit 180, the mobile terminal 100 determines whether or not a specific part of the stored broadcast relevant information, which corresponds to the received first broadcast program, matches the first description information [S2440]. Alternatively, the mobile terminal 100 can extract a specific part, which corresponds to a broadcast program having a current time included in a broadcast duration among broadcast programs provided on the first broadcast channel, from the stored broadcast relevant information and then determine whether or not the extracted specific part matches the first description information.

In this case, the broadcast relevant information can be configured for each broadcast channel or ensemble and can be extracted for each broadcast program. For example, it can be assumed that broadcast guide information (hereinafter "content information") having a content fragment set therein can be configured for each broadcast program. For example, while the mobile terminal 100 is outputting a first broadcast program provided on a first broadcast channel, the mobile terminal 100 can extract content information on a broadcast program having a current time of "09:30 hours" included between a broadcast start time and end time from broadcast relevant information related to the first broadcast channel.

Subsequently, the mobile terminal 100 can determine whether the extracted content information matches the first description information. In this case, the mobile terminal 100 can determine whether the extracted content information matches at least a broadcast start time, a broadcast end time, a broadcast duration, or a broadcast program title included in the first description information. When determining that the specific part of the stored broadcast relevant information corresponding to the first broadcast program does not match the first description information, the mobile terminal 100 can perform an operation to update the stored broadcast relevant information under the control of the controller unit 180.

In the following description, a broadcast relevant information updating process is explained. According to a first embodiment, the mobile terminal 100 can update the stored broadcast relevant information with reference to the received first description information [S2451].

Moreover, when checking the change of the broadcast program title with reference to the first description information, the mobile terminal 100 can display the changed broadcast program title on a prescribed region of an output picture of the first broadcast program while the mobile terminal is outputting the first broadcast program via the output unit 150. In this case, an update of the stored broadcast relevant information may not be provided by the mobile terminal 100.

Moreover, when the mobile terminal 100 is outputting the first broadcast program provided on the first broadcast channel via the output unit 150, the mobile terminal 100 changes a broadcast schedule list of the first broadcast channel with reference to the first description information and is then able to display the changed broadcast schedule list. In this case, an update of the stored broadcast relevant information may not be provided by the mobile terminal 100. According to the second embodiment, the mobile terminal 100 can receive a duplicate copy of broadcast relevant information and is then able to update the stored broadcast relevant information using the received duplicate broadcast relevant information.

The mobile terminal 100 transmits a request signal for broadcast relevant information to a broadcast relevant server via the wireless communication unit 110 under the control of the controller unit 180 [S2461]. For example, the mobile terminal 100 can perform the transmitting step when receiving an input of a command action from a user to transmit the request signal for the broadcast relevant information.

The mobile terminal 100 transmits the request signal for the broadcast relevant information corresponding to a broadcast channel providing a currently output first broadcast program or an ensemble to which the broadcast channel belongs. Alternatively, the mobile terminal 100 can transmit the request signal for the broadcast relevant information corresponding to all of the broadcast channels or ensembles.

As a result of transmitting the request signal for the broadcast relevant information, the mobile terminal 100 re-receives the broadcast relevant information from a broadcast relevant server via the wireless communication unit 110 [S2463]. It can be assumed that the SGDD (e.g., broadcast guide reception relevant information) and the SGDU (e.g., broadcast guide information) are contained in the broadcast relevant information. Accordingly, the mobile terminal 100 can preferentially receive the SGDD.

Alternatively, the mobile terminal 100 can receive both the SGDD and SGDU. Moreover, the mobile terminal 100 can re-receive the broadcast relevant information corresponding to a broadcast channel or an ensemble to which the broadcast channel belongs that provides a currently output first broadcast program or the broadcast relevant information corresponding to all of the broadcast channels or ensembles.

Under the control of the controller unit 180, the mobile terminal 100 determines version information of the re-received broadcast relevant information matches version information of the previously stored broadcast relevant information [S2465]. In this case, the version information is the information that changed according to each change in the broadcast relevant information. Additionally, the version information can indicate whether or not the broadcast relevant information changed.

For example, the mobile terminal 100 can determine whether or not the version information contained in the received SGDD matches the version information of the previously stored SGDD when the mobile terminal 100 re-receives the SGDD first. If it can be determined that the version information contained in the received SGDD matches the version information of the previously stored SGDD, the mobile terminal 100 can receive the SGDU using the received SGDD. Of course, the mobile terminal 100 can re-receive both of the SGDD and SGDU and is thereafter able to determine whether the version information contained in the received SGDU matches the version information of the previously stored SGDU when the version information is contained in the SGDU.

If a match is not detected [S2465], the mobile terminal 100 can determine whether or not a corresponding part of the re-received broadcast relevant information, which corresponds to the first broadcast program, matches the first description information [S2467]. For example, the mobile terminal 100 can determine whether or not the specific part of the SGDU (e.g., broadcast guide information) matches the first description information. If it is determined that each of the version information match each other [S2465], then the mobile terminal 100 can check whether or not broadcast relevant information having version information different from that of the stored broadcast relevant information is received [S2469].

If it is determined that the specific part matches the first description information [S2467], the mobile terminal 100 can then check whether or not broadcast relevant information having version information different from that of the re-received broadcast relevant information is received [S2469]. If it is determined that the specific part does not match the first description information [S2467], the mobile terminal 100 can update the stored broadcast relevant information with reference to the re-received broadcast relevant information [S2471].

If the version information of the broadcast relevant information match each other [S2465] or the version information are different but match the specific part corresponding to the description information [S2467], then it may mean that real broadcast relevant information is not reflected in broadcast relevant information provided by the broadcast relevant server despite the change of real broadcast relevant information with reference to the description information on the currently provided broadcast program. Therefore, the mobile terminal 100 can re-receive the broadcast relevant information periodically or at a random timing point and can check whether or not a substantial change of the broadcast relevant information on a currently received broadcast program is reflected in the re-received broadcast relevant information.

Figure 25:
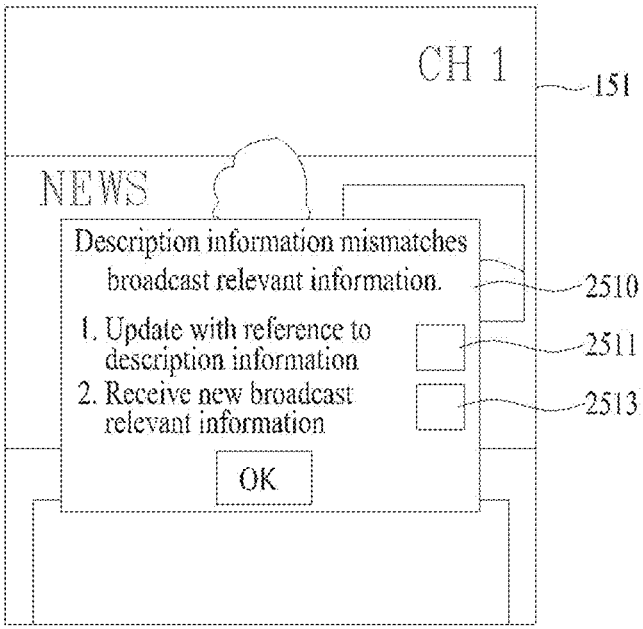
FIG. 25 is a diagram of screen configuration for selecting a broadcast relevant information updating method when description information differs from broadcast relevant information according to an embodiment of the present invention.

For clarity and convenience of the following description, it can be assumed that a first specific part corresponding to a first broadcast program in previously stored broadcast relevant information is different from first description information. FIG. 25 is a diagram of a screen configuration for selecting a broadcast relevant information updating method when description information and broadcast relevant information differ from each other according to an embodiment of the present invention.

Referring to FIG. 25, if the first specific part differs from the first description information, the mobile terminal 100 can display a window 2510 for enabling a user to select a method of updating the previously stored broadcast relevant information. For example, a first method 2511 is an update with reference to the first description information. Additionally, a second method 2513 is an update in a manner of receiving new broadcast relevant information and using the newly received broadcast relevant information.

In the following description, a case that describing selection of the first method is explained. FIGS. 26A to 26D are diagrams of screen configurations of displaying updated broadcast relevant information when broadcast start/end time is different according to an embodiment of the present invention.

Referring to FIG. 26A, a broadcast start time 2601 (e.g., "10:30") and a broadcast end time 2602 (e.g., "11:30"), are contained in description information of a currently output broadcast program. Referring to FIG. 26B, a broadcast start time 2603 (e.g., "10:00") and a broadcast end time 2604 (e.g., "11:00"), are contained in broadcast relevant information corresponding to the currently output broadcast program in previously stored broadcast relevant information.

FIG. 26A illustrates that the broadcast start time of the currently output broadcast program is changed from "10:00" as illustrated in FIG. 26B to "10:30" and the broadcast end time of the currently output broadcast program is changed from "11:00" as illustrated in FIG. 26B to "11:30."

Therefore, the mobile terminal 100 can change a broadcast schedule list of a broadcast channel providing the currently output broadcast program into a broadcast schedule list as shown in FIGS. 26C and 26D. For example, a broadcast duration including broadcast start and end times of a second broadcast program as the currently output broadcast program, is changed from "10:00~11:00" (e.g., first broadcast duration 2605, FIG. 26C) to "10:30~11:30" (e.g., second broadcast duration 2606, FIG. 26D). Additionally, the broadcast start and end times of broadcast programs subsequent to the second broadcast program can be delayed by 30 minutes.

Figures 27A, 27B, 27C:
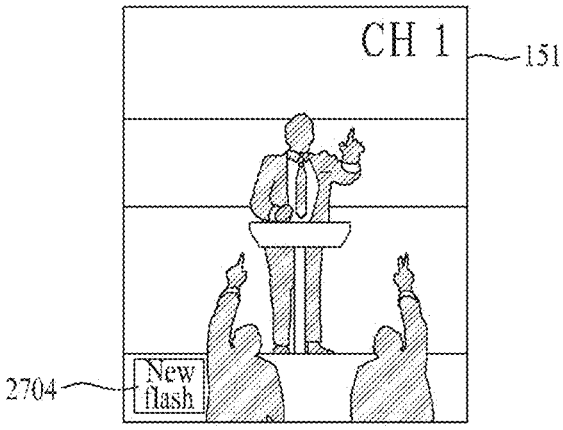
FIGS. 27A to 27C are diagrams of screen configurations of displaying updated broadcast relevant information when a broadcast program title is different according to an embodiment of the present invention.

FIGS. 27A to 27C are diagrams of screen configurations of displaying updated broadcast relevant information when a broadcast program title is different according to an embodiment of the present invention. Referring to FIG. 27A, it can be observed that a broadcast program title (e.g., second broadcast program 2701), is contained in broadcast relevant information corresponding to the currently output broadcast program in previously stored broadcast relevant information. Additionally, it can also be observed that another broadcast program title (e.g., news flash 2702) is contained in description information of a currently output broadcast program.

Namely, FIG. 27A shows that the broadcast program title of the currently output broadcast program can be changed from the second broadcast program 2701 to the news flash 2702. Referring to FIG. 27B, the mobile terminal 100 can change a title of the currently output broadcast program in a broadcast schedule list of a broadcast channel providing the currently output broadcast program from the originally titled broadcast program title, second broadcast program 2605 (FIG. 26C), to the newly titled broadcast program title, news flash 2703 (FIG. 27B).

Moreover, the mobile terminal 100 can display the changed broadcast program title, news flash 2704, on a prescribed region of an output picture of the currently output broadcast program via the display module 151 as illustrated in FIG. 26C.

FIGS. 28A to 28D are diagrams of screen configurations of displaying updated broadcast relevant information when a broadcast start/end time and broadcast program title are different according to an embodiment of the present invention. Referring to FIG. 28A, a current program descriptor list directed to description information of a currently output broadcast program can include a broadcast start time 2801 (e.g., "10:30") and a broadcast end time 2802 (e.g., "11:30"), a broadcast program title 2804 (e.g., "news flash"), and a broadcast duration 2803 (e.g., "30 minutes"). Referring to FIG. 28B, a content fragment list directed to broadcast relevant information corresponding to the currently output broadcast program in previously stored broadcast relevant information can include a broadcast start time 2603 (e.g., "10:00", FIG. 26B) and a broadcast end time 2604 (e.g., "11:00", FIG. 26B), a broadcast duration 2807 (e.g., "1 hour"), and a broadcast program title 2808 (e.g., "second broadcast program").

FIGS. 28A and 28B illustrate the broadcast start time of the currently output broadcast program can be changed from "10:00" to "10:30," the broadcast duration can be changed from "1 hour" to "30 minutes," and the broadcast program title can be changed from "$2^{nd}$ program" to "news flash." Therefore, the mobile terminal 100 can change a broadcast schedule list of a broadcast channel providing the currently output broadcast program into a broadcast schedule list shown in FIGS. 28C to 28D. In this case, FIG. 26C is referred to as a broadcast schedule list before a broadcast schedule list change.

For example, the mobile terminal 100 adds broadcast time slot 2805 (e.g., "10:30~11:00 news flash") to the broadcast schedule list. As a result, the mobile terminal 100 arranges the second broadcast program part interrupted in the broadcast time slot 2805 to be broadcast in program timeslot 2806 (e.g., "11:00~11:30"). In this case, broadcast start and end times of broadcast programs subsequent to the second broadcast program can be delayed by at least 30 minutes, for example.

Alternatively, the mobile terminal 100 can arrange broadcast programs subsequent to the second broadcast program following the broadcast timeslot 2805 (e.g., "10:30~11:00 news flash) instead of arranging the second broadcast program 2808 (FIG. 28B) to be interrupted between the broadcast start time 2801 and the broadcast end time 2802. Meanwhile, when a corresponding interactive service is linked to a broadcast program scheduled to be broadcast on a current time slot with reference to broadcast relevant information, the mobile terminal 100 can perform various control operations when it is determined that the first specific part is different from the first description information (not shown).

For example, the mobile terminal 100 outputs announcement information announcing that the corresponding interactive service information does not exist, does not provide the corresponding interactive service at all, or enables a user to select whether or not to receive a duplicate copy of the corresponding interactive service information from an external server. In particular, when broadcast program titles are different from each other, the mobile terminal 100 may not provide the corresponding interactive service by announcing at least that the corresponding interactive service information does not exist. This is true because the change of the broadcast program title can mean that the broadcast program itself has been changed. If the broadcast start and end times are different from each other, the mobile terminal 100 can provide the corresponding interactive service information for the changed broadcast duration.

For clarity and convenience, the following description is an example of another method directed to an update using newly received broadcast relevant information selected according to a broadcast relevant information updating method as illustrated in FIG. 25. FIGS. 29A to 29F are diagrams of screen configurations for a process of updating broadcast relevant information when broadcast relevant information is re-received according to an embodiment of the present invention.

Figure 29A:
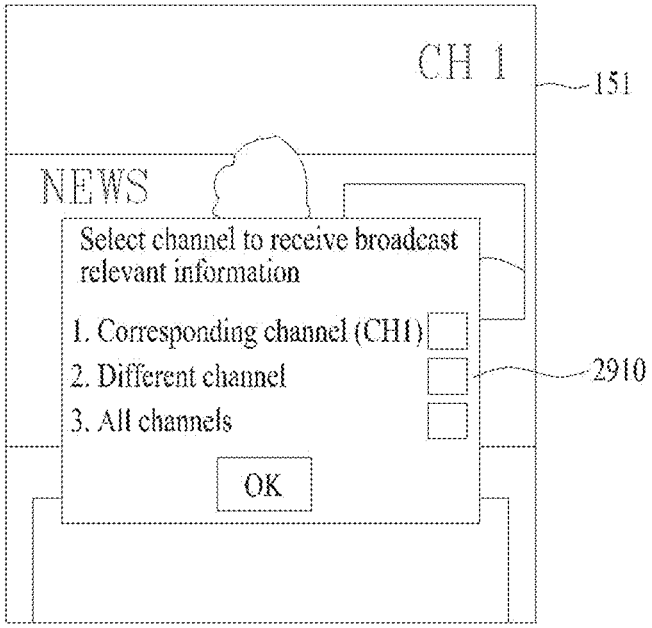
FIGS. 29A to 29F are diagrams of screen configurations for a process of updating broadcast relevant information when broadcast relevant information is re-received according to an embodiment of the present invention.
Figure 29B:
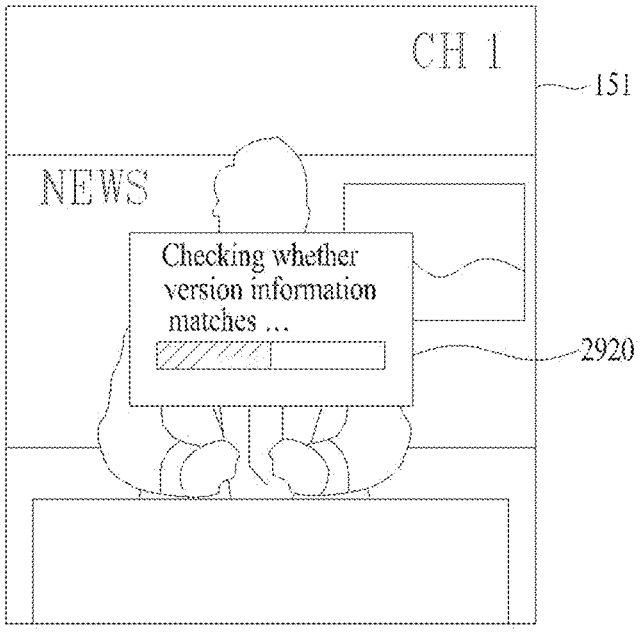

Referring to FIG. 29A, if a second method 2513 is selected (FIG. 25), then the mobile terminal 100 can display a window 2910 for enabling a user to designate a broadcast channel for re-receiving broadcast relevant information by selecting at least a currently used broadcast channel (hereinafter "current broadcast channel"), a different broadcast channel, or all broadcast channels. Referring to FIG. 29B, if the current broadcast channel is selected (FIG. 29A), the mobile terminal 100 re-receives the broadcast relevant information corresponding to the current broadcast channel and is then able to check version information of the re-received broadcast relevant information and version information of previously stored broadcast relevant information. Of course, checking the version information is also applicable to when either the different broadcast channel or all broadcast channels are selected.

Figure 29C:
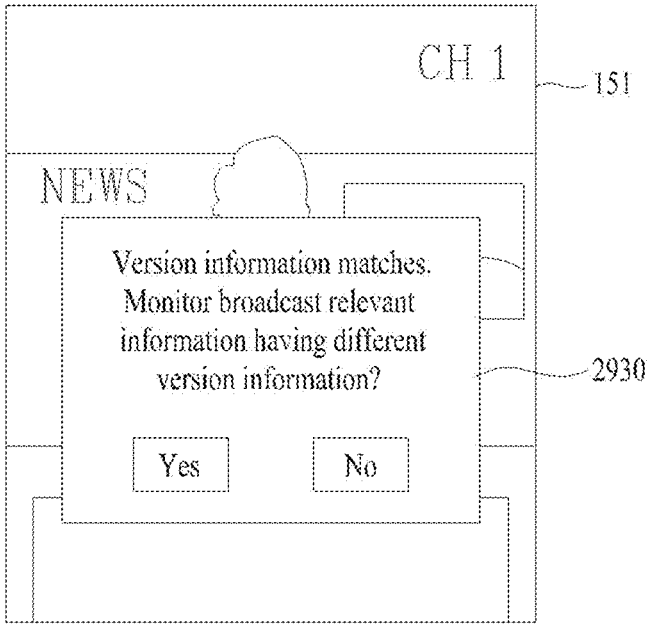

Referring to FIG. 29C, if the checking function in FIG. 29B concludes that each of the version information match each other, the mobile terminal 100 can display a window 2930 via the display module 151 for enabling a user to select whether or not to monitor a presence or non-presence of a reception of the broadcast relevant information having the version information different from the version information of the previously stored broadcast relevant information. If "yes" is selected in FIG. 29C, the mobile terminal 100 can periodically monitor the presence or non-presence of the reception of the broadcast relevant information having the version information different from the version information of the previously stored broadcast relevant information.

Figure 29D:
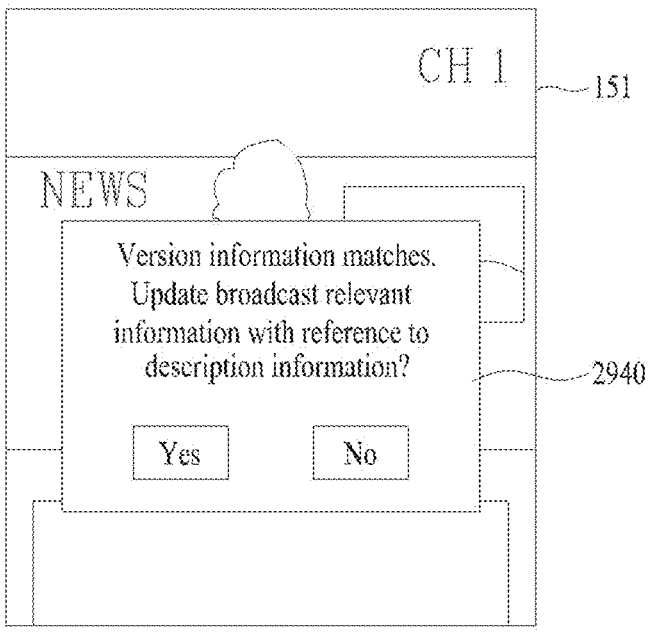
Figure 29E:
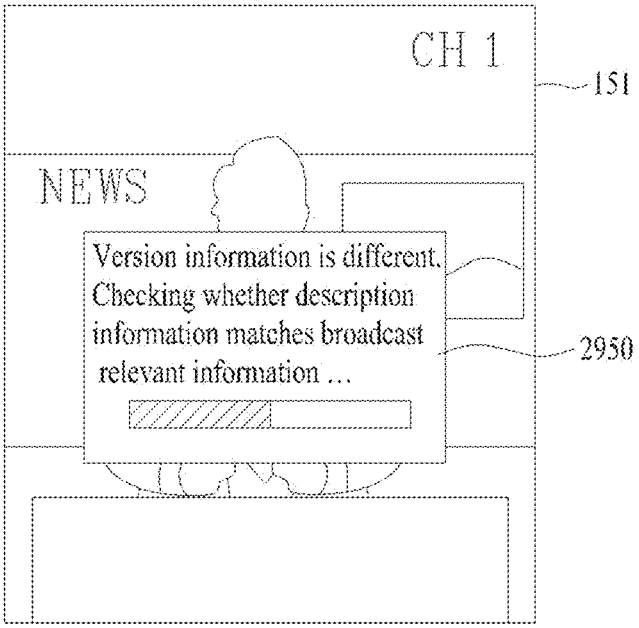

Referring to FIG. 29D, if the checking function in FIG. 29B concludes that each of the version information match each other, then the mobile terminal 100 can display a window 2940 via the display module 151 for enabling a user to select whether to update the broadcast relevant information with reference to description information of a currently received or output broadcast program. Referring to FIG. 29E, if the checking function in FIG. 29B concludes that the version information do not match each other, then the mobile terminal 100 can determine whether or not a specific part corresponding to a currently received or output broadcast program in the re-received broadcast relevant information matches the description information.

Figure 29F:
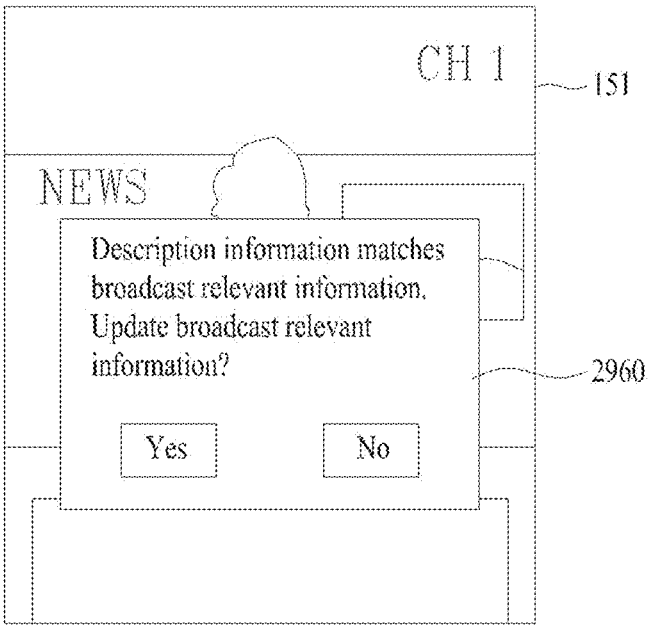

Referring to FIG. 29F, if it is determined that the specific part matches the description information, then the mobile terminal 100 can display a window 2960 via the display module 151 for enabling a user to select whether or not to update the broadcast relevant information with reference to the re-received broadcast relevant information. If "yes" is selected in FIG. 29F, the mobile terminal 100 can update the previously stored broadcast relevant information with reference to the re-received broadcast relevant information.

According to the embodiments of the present invention, if reference time data is not received, the mobile terminal 100 can set a broadcast relevant reference time to a current time provided by the mobile terminal 100 or a current time provided by an external device (e.g., server, terminal).

The broadcast controlling methods of the present invention can be implemented in a program recorded medium such as computer-readable media. The computer-readable media can include recording devices in which data readable by a computer system can be stored. The computer-readable media can include read-only memory (ROM), random access memory (RAM), compact disc read-only memory (CD-ROM), magnetic tapes, floppy discs, or optical data storage devices, for example. Additionally, carrier-wave type implementations (e.g., transmission via Internet) can be included.

Accordingly, embodiments of the present invention provide several effects and/or advantages. First, even if reference time data for providing a reference time is not received, the present invention can set a broadcast relevant reference time using broadcast time information corresponding to a currently received or output broadcast program, or search for specific broadcast relevant information using a set broadcast relevant reference time including broadcast time information corresponding to a currently received or output broadcast program. Second, since previously stored broadcast relevant information can be updated using description information of a currently received broadcast program, the present invention can provide a user with broadcast relevant information having a substantially changed item reflected thereon despite failing to receive a new version of broadcast relevant information from a broadcast relevant server.

It will be apparent to a person having an ordinary skill in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A mobile terminal, comprising:

a wireless communication unit configured to receive data;

an output unit configured to output a received broadcast program;

a memory unit configured to store broadcast relevant information; and a controller configured to:

receive first data comprising a first broadcast program of a first broadcast channel, first description information related to the first broadcast program, and first broadcast relevant information;

determine whether or not the received first data includes reference time information, wherein the reference time information contains current time information related to a broadcast reception or related to a broadcast output and is provided from a network with a predetermined time periodicity;

when the received first data is determined to include the reference time information, set a broadcast relevant reference time using the current time information that is related to the broadcast reception or the broadcast output;

search the stored first broadcast relevant information for specific broadcast relevant information corresponding to the set broadcast relevant reference time, wherein a first broadcast time information comprises at least a broadcast start time, a broadcast end time, or a broadcast duration; and output the specific broadcast relevant information corresponding to the set broadcast relevant reference time;

when the received first data does not include the reference time information, extract the first broadcast time information related to the first broadcast program from the first description information;

set the broadcast relevant reference time using the extracted first broadcast time information;

receive a second broadcast program of the first broadcast channel and second description information related to the second broadcast program when the first broadcast program is switched to the second broadcast program;

extract second broadcast time information related to the second broadcast program from the received second description information;

reset the broadcast relevant reference time using the extracted second broadcast time information; and search for the specific broadcast relevant information in accordance with the reset broadcast relevant reference time, wherein the controller is further configured to release the set broadcast relevant reference time and reset the broadcast relevant reference time using reference time information included in later received data when the later received data is received after the setting of the broadcast relevant reference time.

2. The mobile terminal of claim 1, wherein the controller is further configured to set the broadcast relevant reference time to at least the broadcast start time of the first broadcast program, the broadcast end time of the first broadcast program, or a random timing point in the broadcast duration of the first broadcast program.

3. The mobile terminal of claim 1, wherein the controller is further configured to search the stored first broadcast relevant information for information related to at least detailed program information associated with the first broadcast program that is broadcast at the broadcast relevant reference time, first schedule information including broadcast programs of the first broadcast channel that is broadcast after the broadcast relevant reference time, or second schedule information including broadcast programs of a broadcast channel different from the first broadcast channel that is broadcast after the broadcast relevant reference time.

4. The mobile terminal of claim 3, wherein the detailed program information includes interactive service information related to the first broadcast program.

5. The mobile terminal of claim 1, further comprising:

a user input unit configured to receive a search command to search for the first broadcast relevant information, wherein the controller is further configured to search for the specific broadcast relevant information corresponding to the set broadcast relevant reference time upon receiving the search command.

6. The mobile terminal of claim 1, wherein the controller is further configured to detect the switch from the first broadcast program to the second broadcast program by checking whether the first description information changed to the second description information.

7. The mobile terminal of claim 1, wherein the received first data is received prior to the setting of the broadcast relevant reference time.

8. The mobile terminal of claim 1, wherein the controller is further configured to:

compare the first description information with a specific part of the stored first broadcast relevant information to determine whether or not the specific part matches the first description information, and update the stored first broadcast relevant information to reference the first description information when the specific part is different from the first description information.

9. The mobile terminal of claim 8, wherein the controller is further configured to control the wireless communication unit to transmit a request signal to a broadcast relevant server for the second broadcast relevant information when the specific part is different from the first description information.

10. The mobile terminal of claim 9, wherein the controller is further configured to use version information of the second broadcast relevant information and the stored first broadcast relevant information to determine whether the specific part matches the first description information.

11. A method of controlling a broadcast in a mobile terminal, the method comprising:

receiving first data comprising a first broadcast program of a first broadcast channel and first description information related to the first broadcast program;

outputting the received first broadcast program;

determining whether or not the received first data includes reference time information, wherein the reference time information contains current time information related to a broadcast reception or related to a broadcast output and is provided from a network with a predetermined time periodicity;

when the received first data is determined to include the reference time information that contains the current time information, setting a broadcast relevant reference time using the current time information that is related to the broadcast reception or the broadcast output;

searching previously stored broadcast relevant information for specific broadcast relevant information corresponding to the set broadcast relevant reference time, wherein a first broadcast time information comprises at least a broadcast start time, a broadcast end time, or a broadcast duration; and outputting the specific broadcast relevant information corresponding to the set broadcast relevant reference time; and when the received first data does not include the reference time information, extracting the first broadcast time information related to the first broadcast program from the first description information;

setting the broadcast relevant reference time using the extracted first broadcast time information;

receiving a second broadcast program of the first broadcast channel and second description information related to the second broadcast program when the first broadcast program is switched to the second broadcast program;

extracting second broadcast time information related to the second broadcast program from the received second description information;

resetting the broadcast relevant reference time using the extracted second broadcast time information;

searching for the specific broadcast relevant information in accordance with the reset broadcast relevant reference time; and releasing the set broadcast relevant reference time and resetting the broadcast relevant reference time using reference time information included in later received data when the later received data is received after the setting of the broadcast relevant reference time.

12. The method of claim 11, wherein searching the previously stored broadcast relevant information comprises searching at least detailed program information of the first broadcast program that is broadcast at the broadcast relevant reference time, first schedule information including broadcast programs of the first broadcast channel that is broadcast after the broadcast relevant reference time, or second schedule information including broadcast programs of a broadcast channel different from the first broadcast channel that is broadcast after the broadcast relevant reference time.

13. The method of claim 11, further comprising:

comparing the first description information with a specific part of the previously stored broadcast relevant information that corresponds to the first broadcast program to determine whether the specific part matches the first description information; and updating the stored broadcast relevant information to reference the first description information when the specific part is different from the first description information.

* * * * *